US012377361B2

(12) United States Patent
González et al.

(10) Patent No.: US 12,377,361 B2
(45) Date of Patent: Aug. 5, 2025

(54) TOY VEHICLE

(71) Applicant: Mattel, Inc., El Segundo, CA (US)

(72) Inventors: Omar Rene González, Gardena, CA (US); Brendon Vetuskey, Long Beach, CA (US); Gabriel De La Torre, Los Angeles, CA (US)

(73) Assignee: Mattel, Inc., El Segundo, CA (US)

( * ) Notice: Subject to any disclaimer, the term of this patent is extended or adjusted under 35 U.S.C. 154(b) by 0 days.

(21) Appl. No.: 18/953,390

(22) Filed: Nov. 20, 2024

(65) Prior Publication Data

US 2025/0161834 A1 May 22, 2025

Related U.S. Application Data

(60) Provisional application No. 63/601,535, filed on Nov. 21, 2023.

(51) Int. Cl.
*A63H 17/267* (2006.01)
*A63H 17/12* (2006.01)
*A63H 17/26* (2006.01)

(52) U.S. Cl.
CPC ..... *A63H 17/262* (2013.01); *A63H 17/12* (2013.01); *A63H 17/264* (2013.01)

(58) Field of Classification Search
CPC ..... A63H 17/00; A63H 17/12; A63H 17/26; A63H 17/262; A63H 17/264; A63H 33/003
USPC ..... 446/434, 448, 465, 468, 469, 470
See application file for complete search history.

(56) References Cited

U.S. PATENT DOCUMENTS 2,216,497 A * 10/1940 McHenry ..... A63H 17/38 446/466
2,380,174 A * 7/1945 Haselton ..... A63H 17/262 446/466
2,810,984 A * 10/1957 Gokey ..... A63H 17/12 446/427
2,838,875 A * 6/1958 Hammond ..... A63H 17/262 446/466
3,039,229 A * 6/1962 Van Cleemput ..... A63H 17/05 446/434
3,205,616 A * 9/1965 Nisperly ..... A63H 17/00 446/466
3,462,879 A * 8/1969 Fahrendorff ..... A63H 17/06 446/428
3,492,757 A * 2/1970 Balthazor ..... A63H 17/12 446/426

(Continued)

FOREIGN PATENT DOCUMENTS

CN 104107548 B 9/2016
CN 112915556 A 6/2021

(Continued)

*Primary Examiner* — Alexander R Niconovich
(74) *Attorney, Agent, or Firm* — Edell, Shapiro & Finnan, LLC

(57) ABSTRACT

A toy vehicle includes a body, a first axle, a second axle, and a third axle connected to the body, and three pairs of wheels respectively coupled to the first axle, second axle, or third axle. The toy vehicle also includes a support configured to couple to an additional toy vehicle. Tilting the body of the toy vehicle to a first side causes the first axle to rotate in a first direction and the second and third axles to both rotate in a second direction, the second direction being opposite of the first direction.

20 Claims, 15 Drawing Sheets

(56) References Cited

U.S. PATENT DOCUMENTS 3,594,951 A * 7/1971 Perhacs, Jr. ..... A63H 17/06 446/434
3,599,366 A * 8/1971 Pauly ..... A63H 17/262 446/469
3,619,940 A * 11/1971 Good et al. ..... A63H 17/264 446/469
3,624,961 A * 12/1971 Brubaker ..... A63H 17/38 446/468
3,633,307 A * 1/1972 Steuber ..... A63H 17/262 446/468
3,643,372 A * 2/1972 Nash ..... A63H 17/12 446/425
3,653,147 A * 4/1972 Zbikowski ..... A63H 17/12 446/425
3,675,366 A * 7/1972 Tomiyama ..... A63H 17/06 446/434
3,811,218 A * 5/1974 Salmon ..... A63H 17/262 446/94
4,192,093 A * 3/1980 Hamano ..... A63H 17/00 446/435
4,389,810 A * 6/1983 Green ..... A63H 17/26 446/434
4,393,620 A * 7/1983 Murakami ..... A63H 33/003 446/457
4,477,999 A 10/1984 Harigai et al.
4,504,239 A * 3/1985 Kulesza ..... A63H 27/12 446/435
4,505,686 A * 3/1985 Mariol ..... A63H 33/003 446/478
4,516,948 A * 5/1985 Obara ..... A63H 33/003 446/376
4,516,952 A * 5/1985 Brand ..... A63H 17/06 446/466
4,530,670 A 7/1985 Ohno
4,946,413 A 8/1990 Lehmann et al.
5,019,010 A 5/1991 Nikaido et al.
5,580,296 A * 12/1996 Chow ..... A63H 30/04 446/470
5,676,585 A * 10/1997 Nuermberger, III ... A63H 17/06 446/470
5,846,120 A * 12/1998 Barton, Jr. ..... A63H 17/262 280/483
5,882,241 A * 3/1999 Mullaney ..... A63H 17/36 446/454
5,924,910 A * 7/1999 Liu ..... A63H 17/26 446/470
6,000,988 A 12/1999 Tsai
6,520,829 B1 * 2/2003 Temple ..... A63H 17/26 446/434
6,663,463 B1 12/2003 Dougherty et al.
6,699,096 B2 * 3/2004 Christopherson ..... A63H 17/14 446/298
7,018,264 B2 * 3/2006 Foster ..... A63H 17/006 446/454
7,044,826 B2 * 5/2006 Edwards ..... A63H 17/06 446/454
7,942,721 B2 * 5/2011 Wade ..... A63H 17/02 446/470
7,950,977 B2 * 5/2011 Sun ..... A63H 17/008 446/470
7,950,979 B2 5/2011 Barthold
8,075,364 B2 * 12/2011 Wai ..... A63H 17/44 446/454
8,337,271 B2 * 12/2012 Campbell ..... A63H 33/003 446/376
9,101,849 B2 * 8/2015 Bedolla ..... A63H 33/003
9,566,533 B2 * 2/2017 Bruder ..... A63H 17/12
9,700,809 B1 * 7/2017 Harris ..... A63H 17/05
10,758,833 B2 9/2020 Hamel et al.
2003/0224694 A1 12/2003 Hoeting et al.
2004/0009734 A1 * 1/2004 Needham ..... A63H 17/12 446/94
2007/0054587 A1 3/2007 Myers
2008/0070475 A1 * 3/2008 Hippely ..... A63H 33/003 446/465
2013/0029560 A1 * 1/2013 Mayson ..... A63H 17/38 446/468
2014/0051325 A1 * 2/2014 Paukert ..... A63H 33/003 446/376
2014/0248821 A1 * 9/2014 Hippely ..... A63H 33/003 446/465
2015/0367242 A1 * 12/2015 Calello ..... A63H 17/002 446/465

FOREIGN PATENT DOCUMENTS

CN 110270110 B 6/2024
CN 110302546 B 6/2024
CN 118142181 A 6/2024
CN 110270113 B 8/2024
WO 2008133700 A1 11/2008
WO 2020187087 A1 9/2020

* cited by examiner

TOY VEHICLE

TECHNICAL FIELD

The present application relates generally to toys and, in particular, to one or more toy vehicles with unique designs.

BACKGROUND

Toys provide entertainment for different users, such as children. For example, a toy may include various features with which a child may play. An example toy that may entertain a child is a toy vehicle, which may emulate the appearance, movement, and/or feel of a real-world vehicle. New toys with new features, such as toy vehicles with unique designs and/or appearances, can provide added play value and provide additional entertainment. Thus, innovative toy advancements are continuously desired.

SUMMARY

A toy vehicle is presented herein. According to one example embodiment, the toy vehicle includes a body, a first axle, a second axle, and a third axle connected to the body, a first wheel and a second wheel defining a first pair of wheels coupled to the first axle, a third wheel and a fourth wheel defining a second pair of wheels coupled to the second axle, a fifth wheel and a sixth wheel defining a third pair of wheels coupled to the third axle, and a support configured to couple to an additional toy vehicle. The first wheel, the third wheel, and the fifth wheel are positioned on a first side of the body and the second wheel, the fourth wheel, and the sixth wheel are positioned on a second side of the body. Tilting the body to the first side causes the first wheel, the third wheel, and the fifth wheel to lean towards a central plane bisecting the body, and tilting the body to the second side causes the second wheel, the fourth wheel, and the sixth wheel to lean towards the central plane.

According to another example embodiment, the toy vehicle includes a body, three axles connected to the body, three pairs of wheels that are each coupled to a respective axle of the three axles, and a support configured to couple to an additional toy vehicle. The toy vehicle and the additional toy vehicle are of the same width.

A toy vehicle playset is also presented herein. According to an example embodiment, the toy vehicle playset includes a first toy vehicle with a first plurality of wheels and a second toy vehicle with a second plurality of wheels. A quantity of the first plurality of wheels is greater than a quantity of the second plurality of wheels, and the second toy vehicle is configured to couple to the first toy vehicle. The first toy vehicle and the second toy vehicle are of the same width.

Other systems, methods, features, and advantages will be, or will become, apparent to one with skill in the art upon examination of the following figures and detailed description. All such additional systems, methods, features, and advantages are included within this description and are within the scope of the claimed subject matter.

BRIEF DESCRIPTION OF THE DRAWINGS

The toy vehicle playset presented herein may be better understood with reference to the following drawings and description. Unless dimensions of elements of the drawings are specifically called-out and described herein, it should be understood that the elements in the figures are not necessarily to scale and that emphasis has been placed upon illustrating the principles of the toy vehicle playset. In the figures, like-referenced numerals designate corresponding parts throughout the different views.

DETAILED DESCRIPTION

Overall, a toy vehicle is presented herein. The toy vehicle includes a first body, first axles, and first wheels. The toy vehicle is configured to couple to an additional toy vehicle. For example, the additional toy vehicle may include a second body, second axles, and second wheels. A first quantity of the first axles and of the first wheels of the toy vehicle is greater than a second quantity of the second axles and of the second wheels of the additional toy vehicle. The increased quantity of the first axles and of the first wheels provides sufficient stability and support that, among other advantages, allow the toy vehicle to stably carry and/or haul the additional toy vehicle. The increased quantity of axles and wheels may also create more haptic feedback for a user "driving" the toy vehicle and/or allow the toy vehicle to traverse new and unique obstacles or surfaces. Still further, the increased number of axles and wheels also creates a unique appearance that may increase the visual appeal of the toy vehicle to a user to encourage interactive play with the toy vehicle. In some embodiments, the toy vehicle includes a hitch or tow hook configured to couple to the additional toy vehicle to enable the toy vehicle to drag the additional toy vehicle. In additional or alternative embodiments, the toy vehicle includes a base on which the additional toy vehicle may be placed to enable the toy vehicle to carry the additional toy vehicle. The increased interactive engagement between the toy vehicle and the additional toy vehicle may provide diverse playability and enhance user experience.

Figure 1:
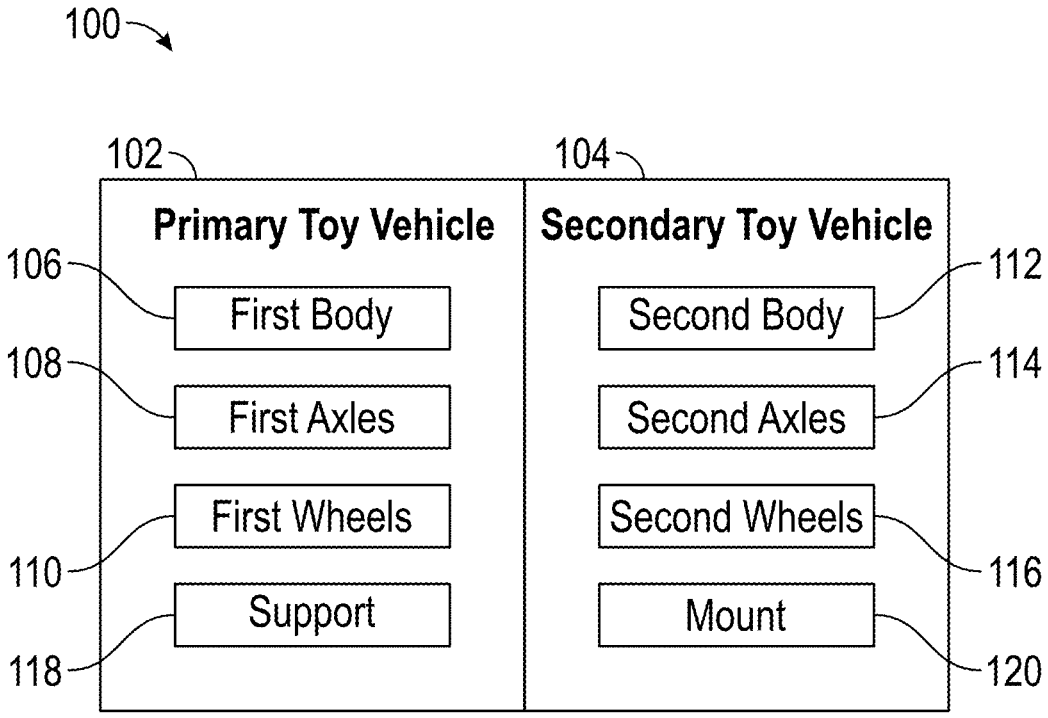
FIG. 1 illustrates a schematic diagram of toy vehicles in accordance with example embodiments of the present application.

FIG. 1 illustrates a schematic diagram of an embodiment of a toy vehicle playset 100 created with the toy vehicle presented herein. The toy vehicle playset 100 includes a primary toy vehicle 102 and a secondary toy vehicle 104. The primary toy vehicle 102 includes a first body or chassis 106, first axles 108 connected to the first body 106, and first wheels 110 connected to the first axles. The secondary toy vehicle 104 includes a second body or chassis 112, second axles 114 connected to the second body 112, and second wheels 116 connected to the second axles 114.

In certain embodiments, the first wheels 110 includes a greater quantity of wheels than the second wheels 116. As an example, the primary toy vehicle 102 may include six first wheels 110, whereas the secondary toy vehicle 104 may include four second wheels 116. As another example, the primary toy vehicle 102 may include greater than six first wheels 110 (e.g., eight first wheels 110) and the secondary toy vehicle 104 may include greater than four second wheels 116 (e.g., six second wheels 116). The first axles 108 also includes a greater quantity of axles than second axles 114 to connect the first wheels 110 to the first body 106. For instance, the first axles 108 may have half as many as the first wheels 110 such that each first axle 108 couples to a pair of the first wheels 110. Additionally, the first body 106 of the primary toy vehicle 102 is larger than the second body 112 of the secondary toy vehicle 104 to accommodate the greater quantity of axles and wheels. By way of example, the first body 106 may be longer (e.g., have a greater length) than the second body 112.

The increased length of the first body 106 and corresponding greater quantity of wheels may provide greater stabilization of the primary toy vehicle 102. For instance, the first wheels 110 may sufficiently support the first body 106 (e.g., block deformation, such as flexure, of the first body 106) and enable a wide variety of desirable orientations (e.g., by blocking flipping or rolling) of the primary toy vehicle 102 during movement. In certain embodiments, each of the first axles 108 may be movable relative to the first body 106 to increase movability of the primary toy vehicle 102. As an example, each first axle 108 may rotate relative to the first body 106, thereby enabling corresponding rotation of the first wheels 110 to help turn the primary toy vehicle 102. Additionally or alternatively, each first axle 108 may move into and out of the first body 106 to adjust extension of the first wheels 110 relative to first body 106, such as to enable the first wheels 110 to conform to a contour of a surface along which the primary toy vehicle 102 moves and facilitate movement of the primary toy vehicle 102 along an uneven surface. As a specific example, each first axle 108 may extend through two slots defined by the first body 106, and the slots may allow each first axle 108 to independently rotate, translate laterally, translate along a length of the slot, and/or tilt.

The primary toy vehicle 102 and the secondary toy vehicle 104 are configured to couple to one another. In the illustrated embodiment, the primary toy vehicle 102 includes a support 118, which is configured to couple to a mount 120 of the secondary toy vehicle 104 to couple the primary toy vehicle 102 and the secondary toy vehicle 104 to one another. In additional or alternative embodiments, the primary toy vehicle 102 may include a mount configured to couple to a support of the secondary toy vehicle. In either case, coupling of the support 118 to the mount 120 may enable the primary toy vehicle 102 to carry or drag the secondary toy vehicle 104. Thus, movement of the primary toy vehicle 102 drives corresponding movement of the secondary toy vehicle 104.

Figure 2A:
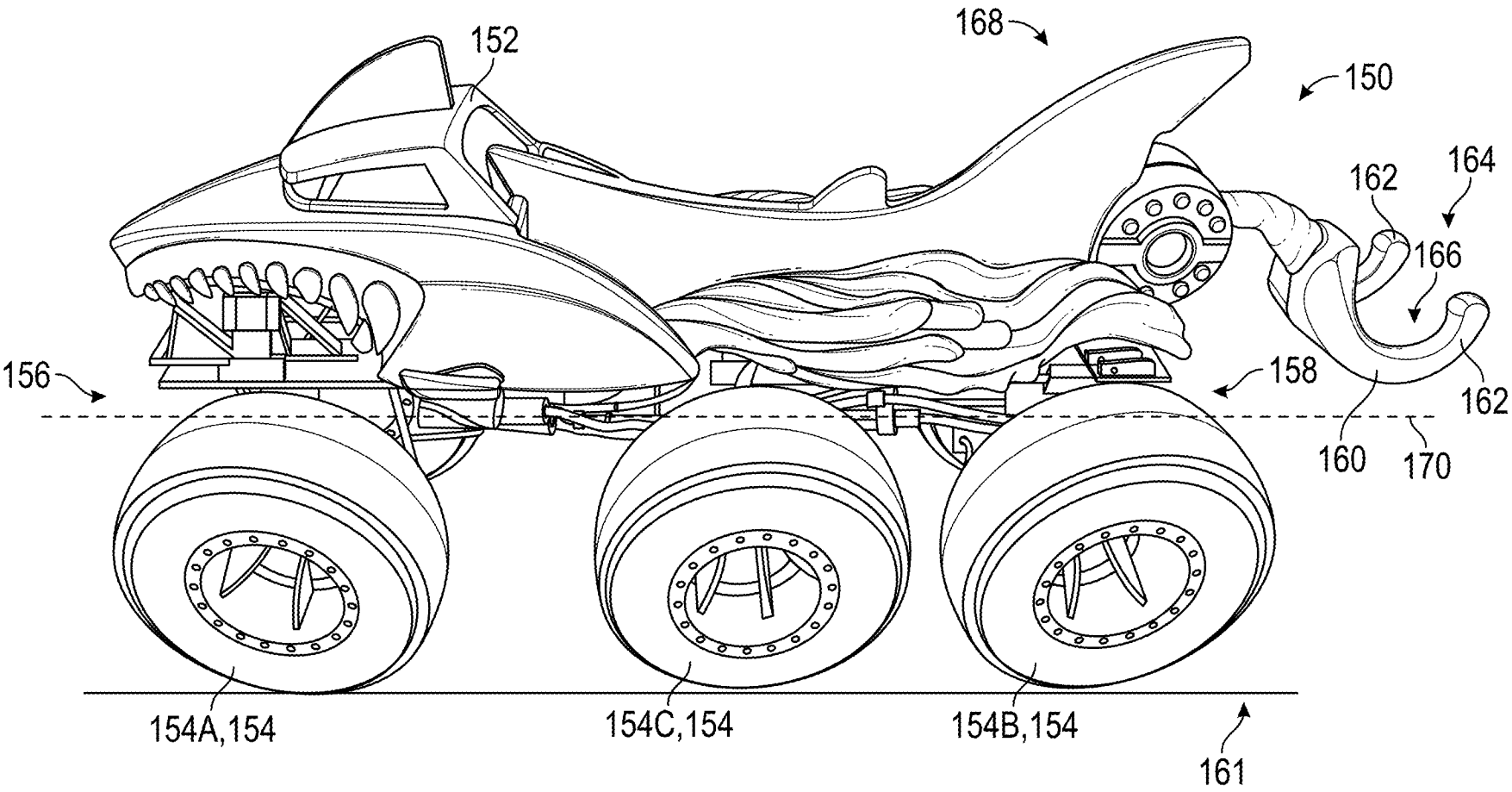
FIG. 2A illustrates a side perspective view of a toy vehicle in an extended configuration in accordance with example embodiments of the present application.

FIG. 2A illustrates a side perspective view of a first toy vehicle 150 (e.g., a first primary toy vehicle). The first toy vehicle 150 includes a body 152 and three pairs of wheels 154 (e.g., coupled to the body 152 via respective axles). The wheels 154 of the first toy vehicle 150 include front wheels 154A positioned at a first end 156 (e.g., a front) of the body 152, rear wheels 154B positioned at a second end 158 (e.g., a rear), opposite the first end 156, of the body 152, and intermediate wheels 154C positioned between the first end 156 and the second end 158. The body 152 of the first toy vehicle 150 is elongated (e.g., has an increased length), and the intermediate wheels 154C may provide stability for the elongated body 152. For example, the intermediate wheels 154C may support/stabilize the body 152 such that each of the wheels 154 abuts against a surface 161 on which the first toy vehicle 150 is placed to avoid bending or flexure of the body 152 and/or avoid undesirable flipping or rolling movement of the body 152.

In the depicted embodiment, the intermediate wheels 154C are positioned closer to the rear wheels 154B to help provide increased stability at the second end 158 of the toy vehicle 150 and/or to help carry/support an additional toy vehicle. This positioning may also "free" the front wheels to be more maneuverable and help ensure that the first toy vehicle 150 has a desirable turning radius and desired steering control. However, in other embodiments, the intermediate wheels 154C may be positioned in any location between the front wheels 154A and the rear wheels 154B. Alternatively, the intermediate wheels 154C need not include the same axle and connection mechanism as that of the front wheels 154A and/or of the rear wheels 154B. In fact, in some embodiments, the "intermediate wheels" may comprise a single wheel.

The first toy vehicle 150 also includes a hitch 160 serving as the support for the first toy vehicle 150. The hitch 160 extends from the body 152 at the second end 158 in the illustrated first toy vehicle 150. However, in additional or alternative embodiments, the first toy vehicle 150 may include a hitch extending from the body 152 at the first end 156. The hitch 160 is configured to couple to an additional toy vehicle to couple the first toy vehicle 150 and the additional toy vehicle to one another. For instance, the hitch 160 may include two fingers 162 that are offset from one another to form a gap 164 therebetween, and each finger 162 has a hook or arcuate shape to form a recess 166 of the hitch 160.

In some embodiments, the hitch 160 is configured to move relative to the body 152 to transition the first toy vehicle 150 between various configurations. FIG. 2A illustrates the first toy vehicle 150 in a first configuration 168

(e.g., an extended configuration, a deployed configuration) in which the hitch 160 extends away from the second end 158. The first configuration 168 may facilitate coupling of the additional toy vehicle to the hitch 160. For instance, the fingers 162 of the hitch 160, and therefore the gap 164 and the recess 166 of the hitch 160, may be offset from the body 152 of the first toy vehicle 150 along a longitudinal axis 170 to increase accessibility of the hitch 160 for coupling to the additional toy vehicle.

Figure 2B:
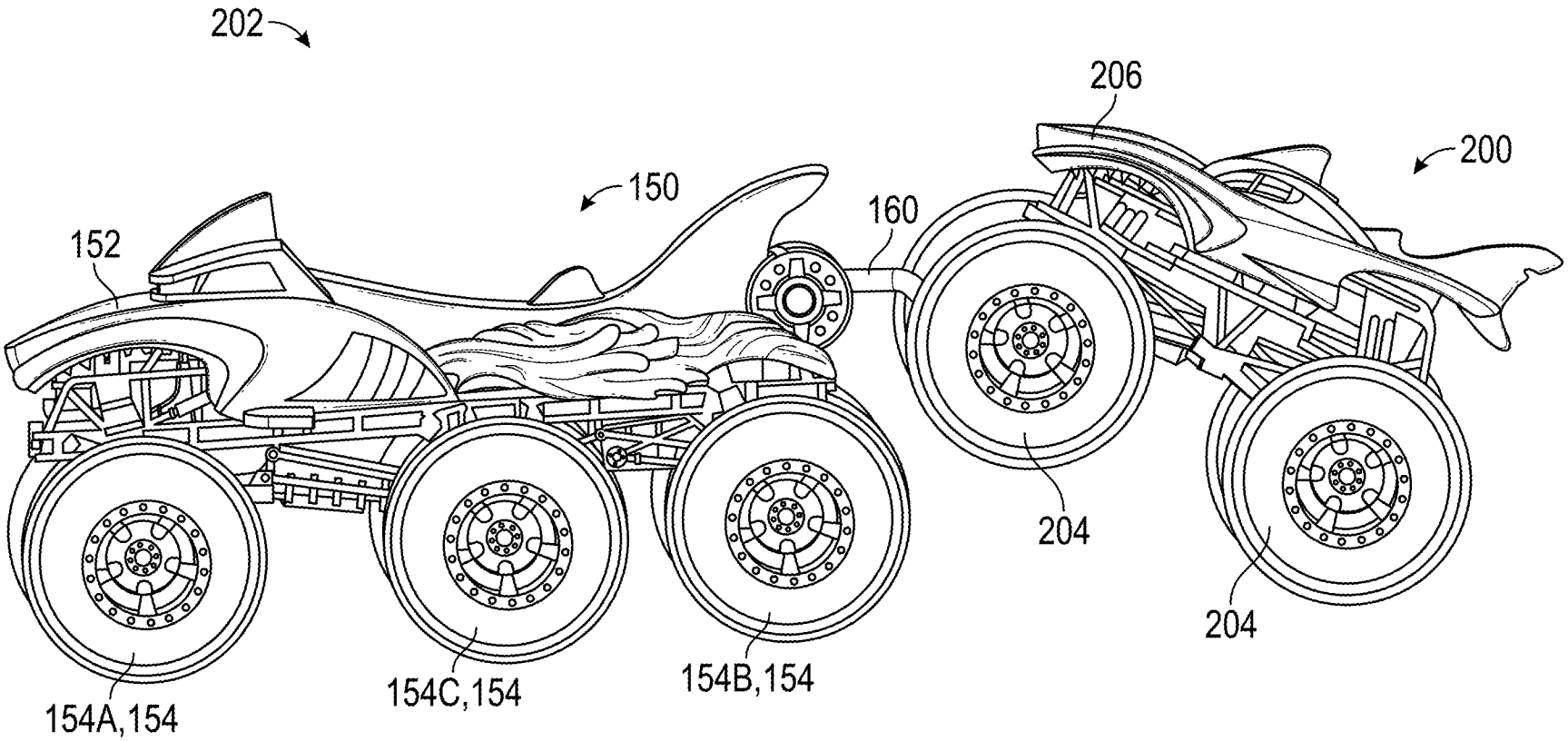
FIG. 2B illustrates a side perspective view of the toy vehicle of FIG. 2A coupled to an additional toy vehicle in accordance with example embodiments of the present application.

FIG. 2B illustrates a side perspective view of the first toy vehicle 150 coupled to a second toy vehicle 200 (e.g., a first secondary toy vehicle) to provide a first toy vehicle playset 202. The illustrated second toy vehicle 200 includes two pairs of wheels 204. Therefore, the first toy vehicle 150 includes a greater quantity of wheels than that of the second toy vehicle 200. Additionally, the second toy vehicle 200 includes a body 206 that is relatively shorter than the body 152 of the first toy vehicle 150. The width of the first toy vehicle 150 is the same as or substantially similar to the width of the second toy vehicle 200. For example, a distance between wheels 154 of the same axle of the first toy vehicle 150 may be substantially similar to a distance between wheels 204 of the same axle of the second toy vehicle 200. The similar width dimensions of the first toy vehicle 150 and second toy vehicle 200 allow the first toy vehicle 150, the second toy vehicle 200, and the first toy vehicle playset 202 (i.e., the first toy vehicle 150 coupled to the second toy vehicle 200) to all be compatible with the same toy vehicle tracks and playsets. In other words, the first toy vehicle 150 and the first toy vehicle playset 202 may be used with other toy vehicle playsets that have a track width designed for the second toy vehicle 200.

The first toy vehicle 150 is coupled to the second toy vehicle 200 via the hitch 160. Specifically, the hitch 160 is coupled to a mount (not shown) extending from the body 206 of the second toy vehicle 200. As such, the first toy vehicle 150 is configured to drag the second toy vehicle 200. That is, movement of the first toy vehicle 150 drives corresponding movement of the second toy vehicle 200.

Figure 2C:
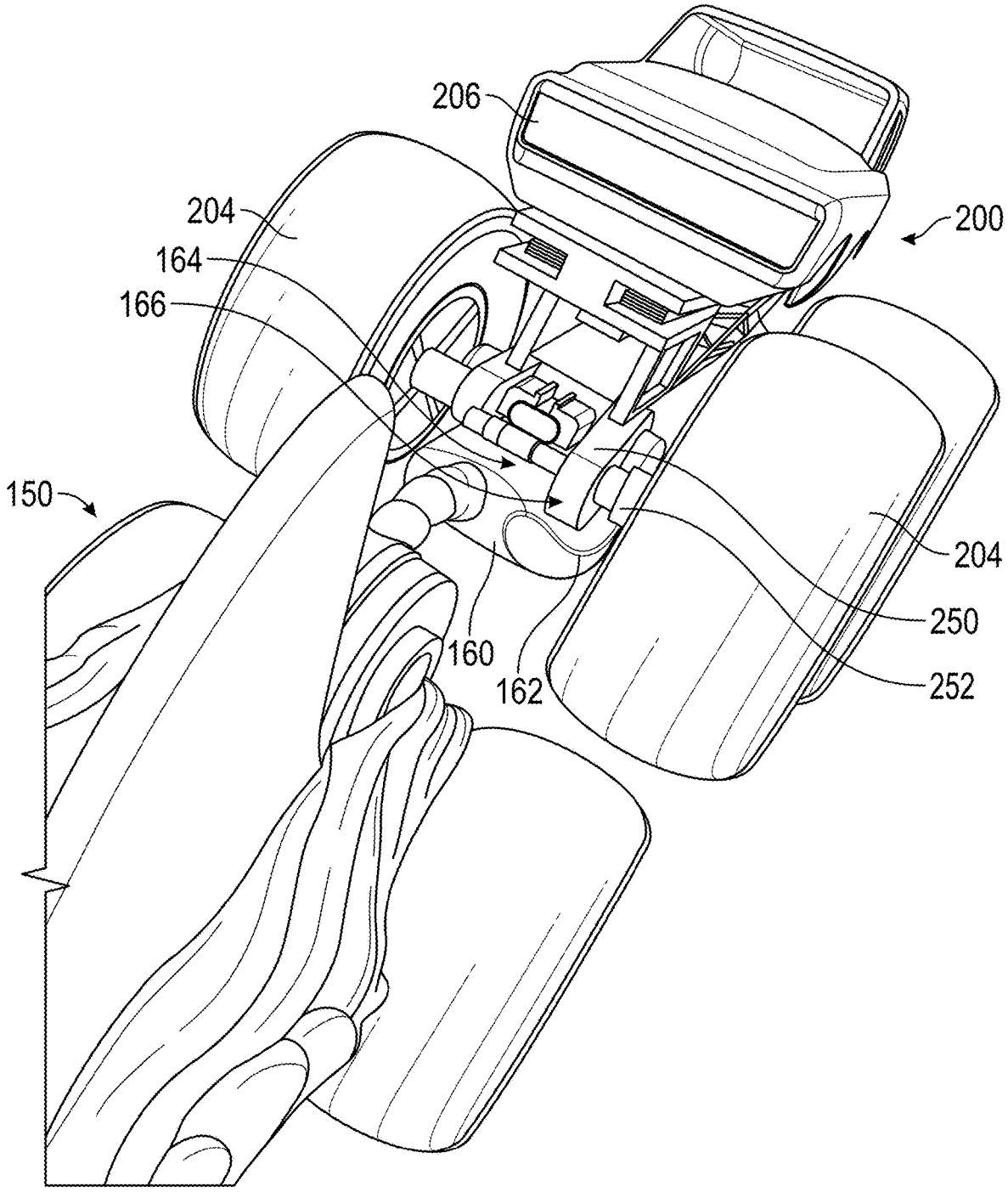
FIG. 2C illustrates a top perspective view of the toy vehicle of FIG. 2A coupled to the additional toy vehicle in accordance with example embodiments of the present application.

FIG. 2C illustrates a top perspective view of the first toy vehicle 150 coupled to the second toy vehicle 200. The second toy vehicle 200 includes a frame 250 (e.g., struts) serving as the mount for coupling to the hitch 160 of the first toy vehicle 150. The frame 250 extends from the body 206 of the second toy vehicle 200, and an axle 252 (e.g., a front axle coupled to front wheels) of the second toy vehicle 200 extends from the frame 250. The frame 250 is positioned within the gap 164 between the fingers 162 of the hitch 160, and the fingers 162 of the hitch 160 engage the frame 250 to capture the frame 250 within the gap 164. Additionally, the axle 252 of the second toy vehicle 200 is positioned within the recess 166 of the hitch 160, and the fingers 162 of the hitch 160 engage with the axle 252 to capture the axle 252 within the recess 166. The cooperative capture of the frame 250 within the gap 164 between the fingers 162 and of the axle 252 within the recess 166 of the hitch 160 helps secure the hitch 160 to the second toy vehicle 200 to couple the first toy vehicle 150 and the second toy vehicle 200 to one another.

Figure 2D:
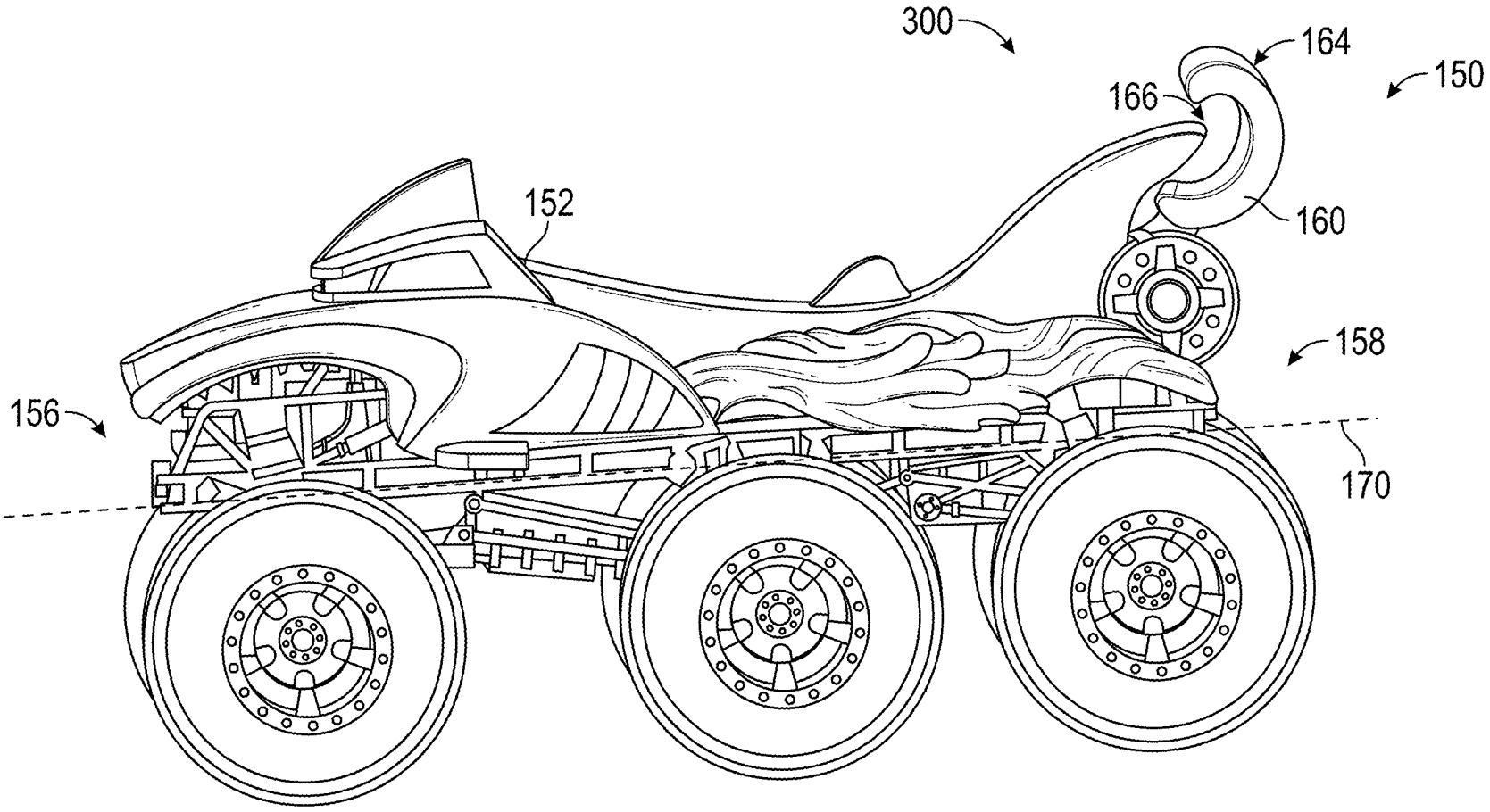
FIG. 2D illustrates a side perspective view of the toy vehicle of FIG. 2A in a retracted configuration in accordance with example embodiments of the present application.

FIG. 2D illustrates a side perspective view of the first toy vehicle 150 in a second configuration 300 (e.g., a retracted configuration, a stowed configuration) in which the position of the hitch 160 is adjusted as compared to the first configuration 168. To enable this, the hitch 160 may be inserted and partially stored within the body 152 of the first toy vehicle 150 (e.g., via a manually applied force) such that the hitch 160, and therefore the gap 164 and the recess 166 of the hitch 160, is positioned proximate to and overlapping with the second end 158 of the body 152 along the longitudinal axis 170 in the second configuration 300. As such, accessibility of the hitch 160 may be reduced (e.g., the hitch 160 is not configured to couple to the second toy vehicle 200) in the second configuration 300 of the first toy vehicle 150. Instead, the second configuration 300 of the first toy vehicle 150 may reduce an overall physical footprint occupied by the first toy vehicle 150, such as to facilitate movement, transportation, and/or placement of the first toy vehicle 150, particularly in a limited space.

Figure 3A:
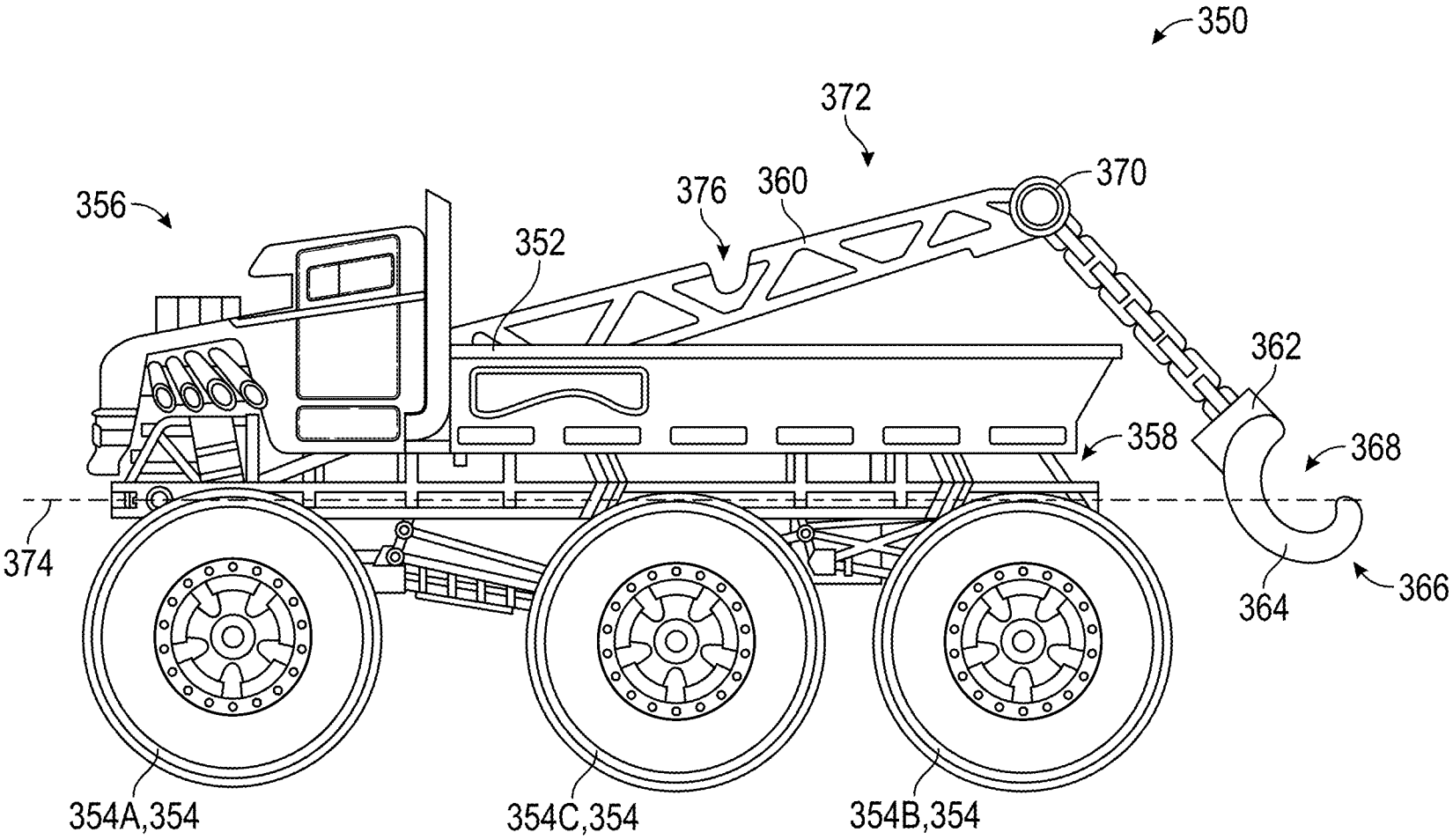
FIG. 3A illustrates a side view of another toy vehicle in accordance with example embodiments of the present application.

FIG. 3A illustrates a side view of a third toy vehicle 350 (e.g., a second primary toy vehicle). The third toy vehicle 350 also has a body 352 and three pairs of wheels 354, which include front wheels 354A positioned at a first end 356 (e.g., a front) of the body 352, rear wheels 354B positioned at a second end 358 (e.g., a rear), opposite the first end 356, of the body 352, and intermediate wheels 354C positioned between the first end 356 and the second end 358. The body 352 of the third toy vehicle 350 is elongated as well.

The third toy vehicle 350 further includes an arm 360 extending from the body 352 (e.g., from the first end 356 toward the second end 358) and a hitch 362 coupled to the arm 360. The arm 360 and the hitch 362 cooperatively serve as the support for the third toy vehicle 350. In some embodiments, the hitch 362 of the third toy vehicle 350 has a similar configuration as that of the hitch 160 of the first toy vehicle 150 and includes two fingers 364 defining a gap 366 and a recess 368. Additionally, in certain embodiments, the hitch 362 is configured to move (e.g., via a manually applied force) relative to the arm 360. For instance, the hitch 362 may be pivotably coupled to the arm 360 at a hinge 370 so that the hitch 362 is configured to rotate relative to the arm 360 via the hinge 370. FIG. 3A illustrates the third toy vehicle 350 in a first configuration 372 (e.g., an extended configuration, a deployed configuration) in which the hitch 362 extends away from the second end 358 of the body 352 such that the fingers 364 of the hitch 362, and therefore the gap 366 and the recess 368 of the hitch 362, are offset from the body 352 of the third toy vehicle 350 along a longitudinal axis 374. As such, accessibility of the hitch 362 is increased to enable coupling to an additional toy vehicle. Rotation of the hitch 362 relative to the arm 360 transitions the third toy vehicle 350 to a second configuration (e.g., a retracted configuration, a stowed configuration) in which the hitch 362, and therefore the gap 366 and the recess 368 of the hitch 362, overlaps with the body 352 along the longitudinal axis 374. By way of example, the arm 360 includes a cutout 376 and a portion of the hitch 362 (e.g., the fingers 364) may be positioned within the cutout 376 upon rotation of the hitch 362 to extend along the arm 360. As a result, in the second configuration, the third toy vehicle 350 may have a substantially reduced physical footprint.

Figure 3B:
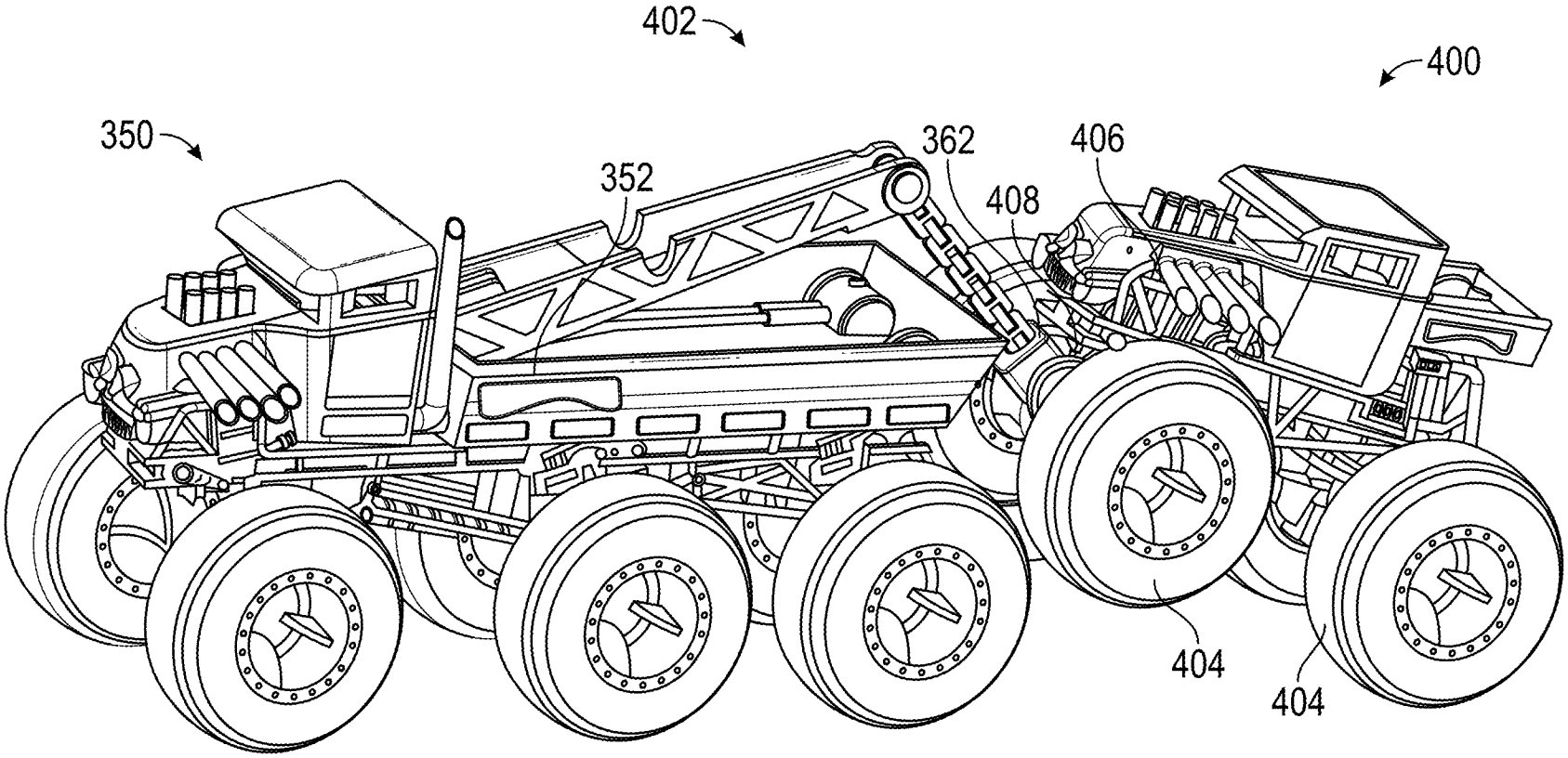
FIG. 3B illustrates a side perspective view of the toy vehicle of FIG. 3A coupled to an additional toy vehicle in accordance with example embodiments of the present application.

FIG. 3B illustrates a top perspective view of the third toy vehicle 350 coupled to a fourth toy vehicle 400 (e.g., a second secondary toy vehicle) to provide a second toy vehicle playset 402. The fourth toy vehicle 400 includes two pairs of wheels 404 and a body 406 that is relatively shorter than the body 352 of the third toy vehicle 350. Additionally, the third toy vehicle 350 is coupled to the fourth toy vehicle 400 via the hitch 362. By way of example, the hitch 362 is coupled to a mount (not shown) extending from the body 406 of the fourth toy vehicle 400. For instance, the mount of the fourth toy vehicle 400 includes a frame 408 from which an axle (not shown) of the fourth toy vehicle 400 extends, and the hitch 362 is configured to capture the frame 408 and the axle (e.g., within the gap 366 between the fingers 364 and within the recess 368, respectively) to secure to the fourth toy vehicle 400. As such, the third toy vehicle 350 is configured to drag the fourth toy vehicle 400 such that movement of the third toy vehicle 350 drives corresponding movement of the fourth toy vehicle 400. The width of the third toy vehicle 350 (e.g., the width between the wheels 354 of the same axle of the third toy vehicle 350) is the same as or substantially similar to the width of the fourth toy vehicle 400 (e.g., the width between the wheels 404 of the same axle of the fourth toy vehicle 400). The similar width dimensions of the third toy vehicle 350 and fourth toy vehicle 400 allow the third toy vehicle 350, the fourth toy vehicle 400, and the second toy vehicle playset 402 (i.e., the third toy vehicle 350 coupled to the fourth toy vehicle 400) to all be compatible with the same toy vehicle tracks and playsets. In other words, the third toy vehicle 350 and the second toy vehicle playset 402 may be used with other toy vehicle playsets that have a track width designed for the fourth toy vehicle 400.

Figure 4A:
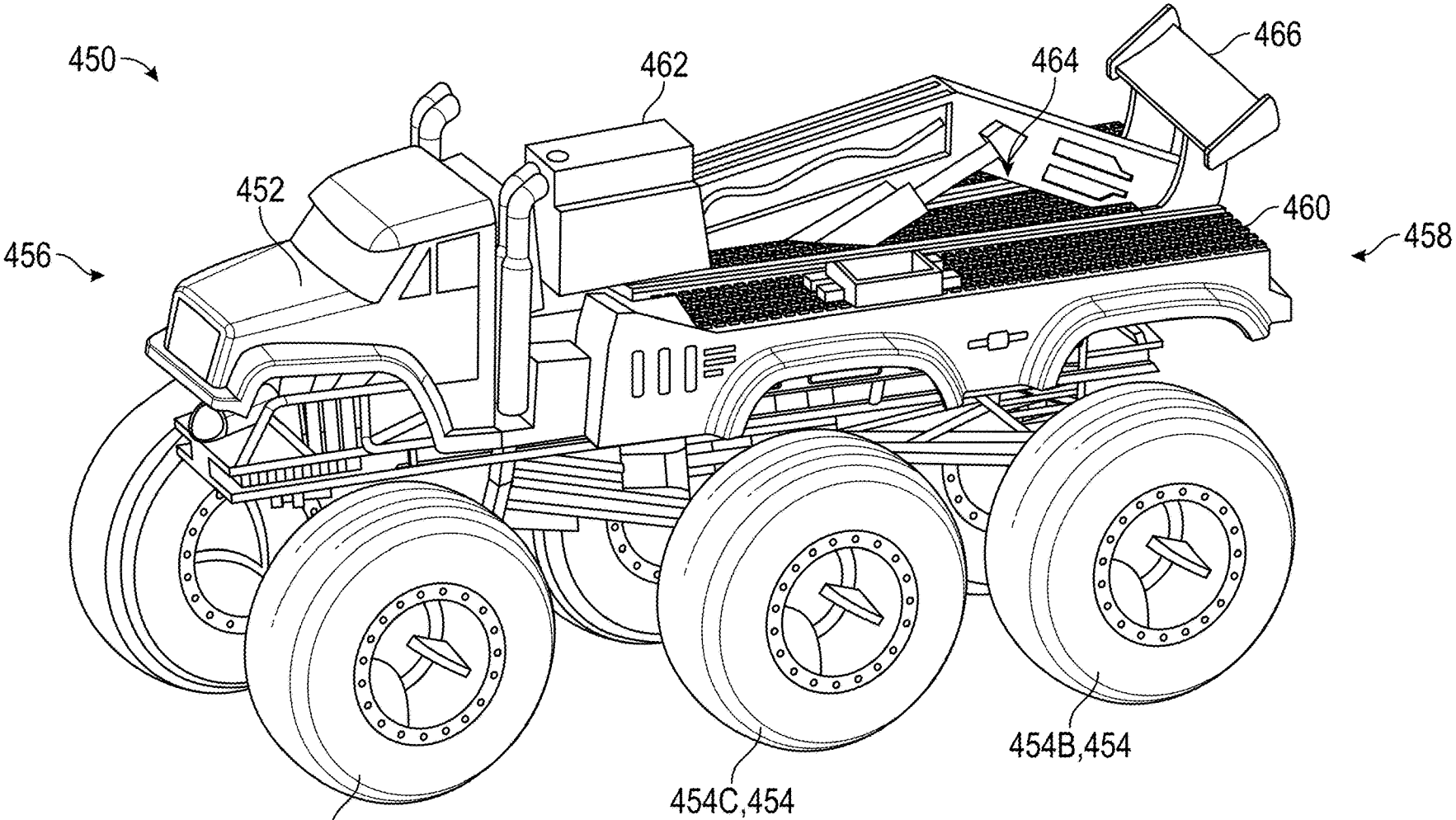
FIG. 4A illustrates a side perspective view of yet another toy vehicle in accordance with example embodiments of the present application.

FIG. 4A illustrates a top perspective view of a fifth toy vehicle 450 (e.g., a third primary vehicle). The fifth toy vehicle 450 includes a body 452 and three pairs of wheels 454, which includes front wheels 454A positioned at a first end 456 (e.g., a front) of the body 452, rear wheels 454B positioned at a second end 458 (e.g., a rear), opposite the first end 456, of the body 452, and intermediate wheels 454C positioned between the first end 456 and the second end 458. The body 452 of the fifth toy vehicle 450 is elongated.

The body 452 of the fifth toy vehicle 450 includes a base 460 (e.g., a flatbed) and a prop 462 serving as the support for coupling to an additional toy vehicle. That is, each of the base 460 and the prop 462 is configured to engage with the additional toy vehicle to secure the fifth toy vehicle 450 and the additional toy vehicle to one another. The prop 462 extends along the middle of the base 460 from the first end 456 to the second end 458. For example, the base 460 may include a space 464 in which the prop 462 is positioned. Moreover, the fifth toy vehicle 450 includes a fin 466 (e.g., a spoiler) positioned at the second end 458, and the prop 462 may extend to the fin 466.

Figure 4B:
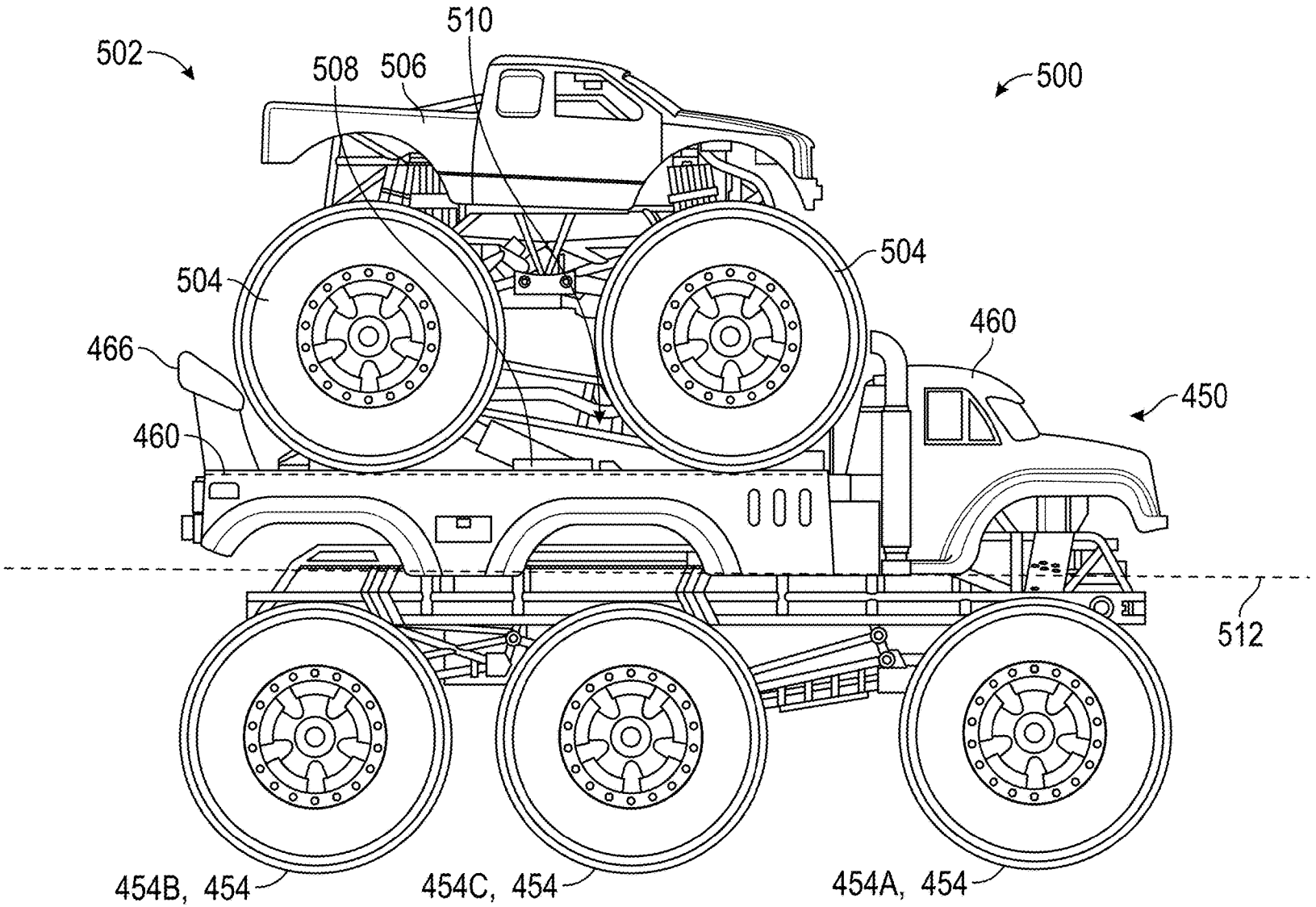
FIG. 4B illustrates a side view of the toy vehicle of FIG. 4A coupled to an additional toy vehicle in accordance with example embodiments of the present application.

FIG. 4B illustrates a side view of the fifth toy vehicle 450 coupled to a sixth toy vehicle 500 (e.g., a third secondary toy vehicle) to provide a third toy vehicle playset 502. The sixth toy vehicle 500 includes two pairs of wheels 504 and a body 506 that is relatively shorter than the body 452 of the fifth toy vehicle 450. The sixth toy vehicle 500 is placed on the base 460 of the fifth toy vehicle 450 to engage the wheels 504 of the sixth toy vehicle 500 with the base 460 and couple the fifth toy vehicle 450 and the sixth toy vehicle 500 to one another. For example, the fifth toy vehicle 450 is configured to carry the sixth toy vehicle 500 such that movement of the fifth toy vehicle 450 drives corresponding movement of the sixth toy vehicle 500. The intermediate wheels 454C of the fifth toy vehicle 450 provides support to block flexure or bending of the body 452 and/or of the base 460 of the fifth toy vehicle 450 that otherwise may be caused by positioning of the sixth toy vehicle 500 on the fifth toy vehicle 450.

To secure the sixth toy vehicle 500 onto the base 460, the base 460 includes bumps or blocks 508 that defines a recess 510 configured to receive one of the wheels 504 (e.g., one of the front wheels) of the sixth toy vehicle 500. That is, the front wheels 504 of the sixth toy vehicle 500 are configured to be positioned within the recess 510, and the bumps 508 are configured to engage with the front wheels 504 to block movement of the front wheels 504 out of the recess 510. Consequently, the front wheels 504 remain within the recess 510 to block substantial movement (e.g., translation) of the sixth toy vehicle 500 relative to the fifth toy vehicle 450 along a longitudinal axis 512 that would otherwise cause the sixth toy vehicle 500 to roll off the base 460. Thus, the recess 510 helps maintain placement of the sixth toy vehicle 500 on the base 460. The fin 466 of the fifth toy vehicle 450 may also help couple the sixth toy vehicle 500 to the fifth toy vehicle 450. For example, the fin 466 may be configured to engage with another of the wheels 504 (e.g., a rear wheel) and/or the body 506 of the sixth toy vehicle 500 to block movement of the sixth toy vehicle 500 off the base 460, thereby maintaining placement of the sixth toy vehicle 500 on the base 460. That all being said, in other embodiments, a toy vehicle including a base similar to the base 460 of the fifth toy vehicle 450 depicted in FIGS. 4A and 4B may include any desirable features that help secure an additional toy vehicle on the base 460, either in addition to or instead of the bumps 508 and recess 510 depicted in these figures.

In some embodiments, the wheels 454 of the fifth toy vehicle 450 and the wheels 504 of the sixth toy vehicle 500 may have similar dimensions, such as substantially the same diameters. Thus, the size disparity between the fifth toy vehicle 450 and the sixth toy vehicle 500 (e.g., the increase in length of the fifth toy vehicle 450) may be primarily attributed to the difference in size of the bodies, rather than of the wheels 454, 504. For example, both the fifth toy vehicle 450 and the sixth toy vehicle 500 (as well as the first, second, third, and fourth toy vehicles 150, 200, 350, 400) may be die-cast, small-scale models of monster trucks or another such vehicle (e.g., 1:64 scale monster truck) having oversized wheels compared to a size of the body, such as wheels that have the same or a greater height than that of the body. By comparison, many common toy vehicles are a die-cast, small-scale models of production cars or a similarly sized vehicles, like 1:64 scale toy vehicles produced and sold as HOT WHEELS or MATCHBOX toy vehicles. Thus, the fifth toy vehicle 450 and the sixth toy vehicle 500 (as well as the first, second, third, and fourth toy vehicles 150, 200, 350, 400) may have overall widths (e.g., distance between wheels of the same axle) that are similar to each other, but these widths may be larger than (e.g., double) corresponding dimensions of common toy vehicles.

Figure 4C:
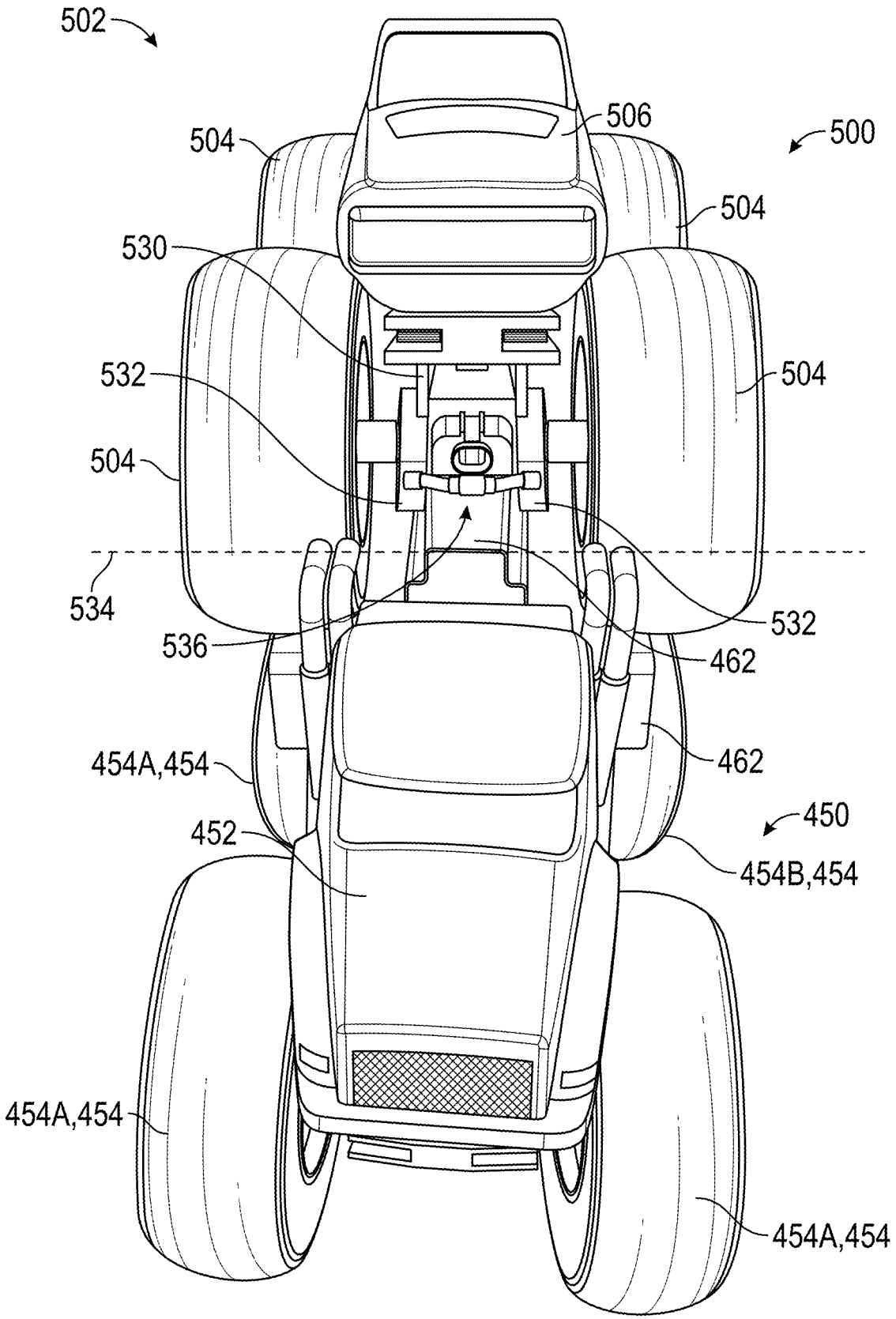
FIG. 4C illustrates a front perspective view of the toy vehicle of FIG. 4A coupled to the additional toy vehicle in accordance with example embodiments of the present application.

FIG. 4C illustrates a front perspective view of the fifth toy vehicle 450 coupled to the sixth toy vehicle 500 via placement of the sixth toy vehicle 500 on the base 460 of the fifth toy vehicle 450. The illustrated sixth toy vehicle 500 includes a frame 530 (e.g., struts) extending from the body 506, and the frame 530 serves as the mount to couple the sixth toy vehicle 500 to the fifth toy vehicle 450. For instance, the frame 530 includes lips 532 that are offset from one another along a lateral axis 534 to define a gap 536 extending therebetween. The gap 536 is configured to receive a portion of the prop 462 of the fifth toy vehicle 450 such that the lips 532 capture the prop 462 within the gap 536. As a result, the lips 532 engage with the prop 462 to block movement of the sixth toy vehicle 500 relative to the fifth toy vehicle 450 along the lateral axis 534 (e.g., tipping or sliding of the sixth toy vehicle 500 relative to the base 460) to maintain placement of the sixth toy vehicle 500 on the base 460.

A dimension (e.g., a distance between the wheels 454 of the same axle) of the fifth toy vehicle 450 may be the same as or substantially similar to a dimension (e.g., a distance between the wheels 504 of the same axle) of the sixth toy vehicle 500. Moreover, as discussed above, the wheels 454 of the fifth toy vehicle 450 and the wheels 504 of the sixth toy vehicle 500 may have similar dimensions. As such, the width and/or diameter of the wheels 454 of the fifth toy vehicle 450 and the width and/or diameter of the wheels 504 of the sixth toy vehicle 500, respectively, may also be similar to one another. For this reason, positioning the sixth toy vehicle 500 on the fifth toy vehicle 450 may align the bodies 452, 506 of the fifth toy vehicle 450 and of the sixth toy vehicle 500 with one another along the lateral axis 534, as well as the wheels 454, 504 of the fifth toy vehicle 450 and of the sixth toy vehicle 500 with another. In other words, the sixth toy vehicle 500 may be vertically aligned with the fifth toy vehicle 450 when the sixth toy vehicle 500 is stacked on the fifth toy vehicle 450. Such an alignment between the fifth toy vehicle 450 and the sixth toy vehicle 500 may help position the sixth toy vehicle 500 to secure to the fifth toy vehicle 450, such as by engaging the frame 530 of the sixth toy vehicle 500 with the prop 462 of the fifth toy vehicle 450 and/or by positioning the wheels 504 of the sixth toy vehicle 500 in the recess 510 of the base 460 of the fifth toy vehicle 450. Furthermore, the overall width of the fifth toy vehicle 450 being the same as the overall width of the sixth toy vehicle 500 results in the third toy vehicle playset 502 (i.e., fifth toy vehicle 450 coupled to the sixth toy vehicle 500) also being the same width. This allows the fifth toy vehicle 450 and the third toy vehicle playset 502 to be played on certain toy vehicle tracks and playsets designed for the sixth toy vehicle 500, even though the fifth toy vehicle 450 and the third toy vehicle playset 502 are respectively longer and taller than the sixth toy vehicle 500.

The base 460 of the fifth toy vehicle 450 extends sufficiently outward along the lateral axis 534 to accommodate the wheels 504 of the sixth toy vehicle 500. That is, the base 460 provides a sufficient surface area of engagement with the wheels 504 for the sixth toy vehicle 500 to balance atop the fifth toy vehicle 450. To this end, a width of the base 460 of the fifth toy vehicle 450 along the lateral axis 534 may be greater than a width of the body 506 of the sixth toy vehicle 500 along the lateral axis 534 to accommodate a distance between the wheels 504 of the same axle (e.g., a distance substantially similar to that between the wheels 454 of the same axle) and sufficiently engage with the wheels 504. Thus, the base 460 may overlap with the wheels 454 of the fifth toy vehicle 450 along the lateral axis 534.

Figure 5A:
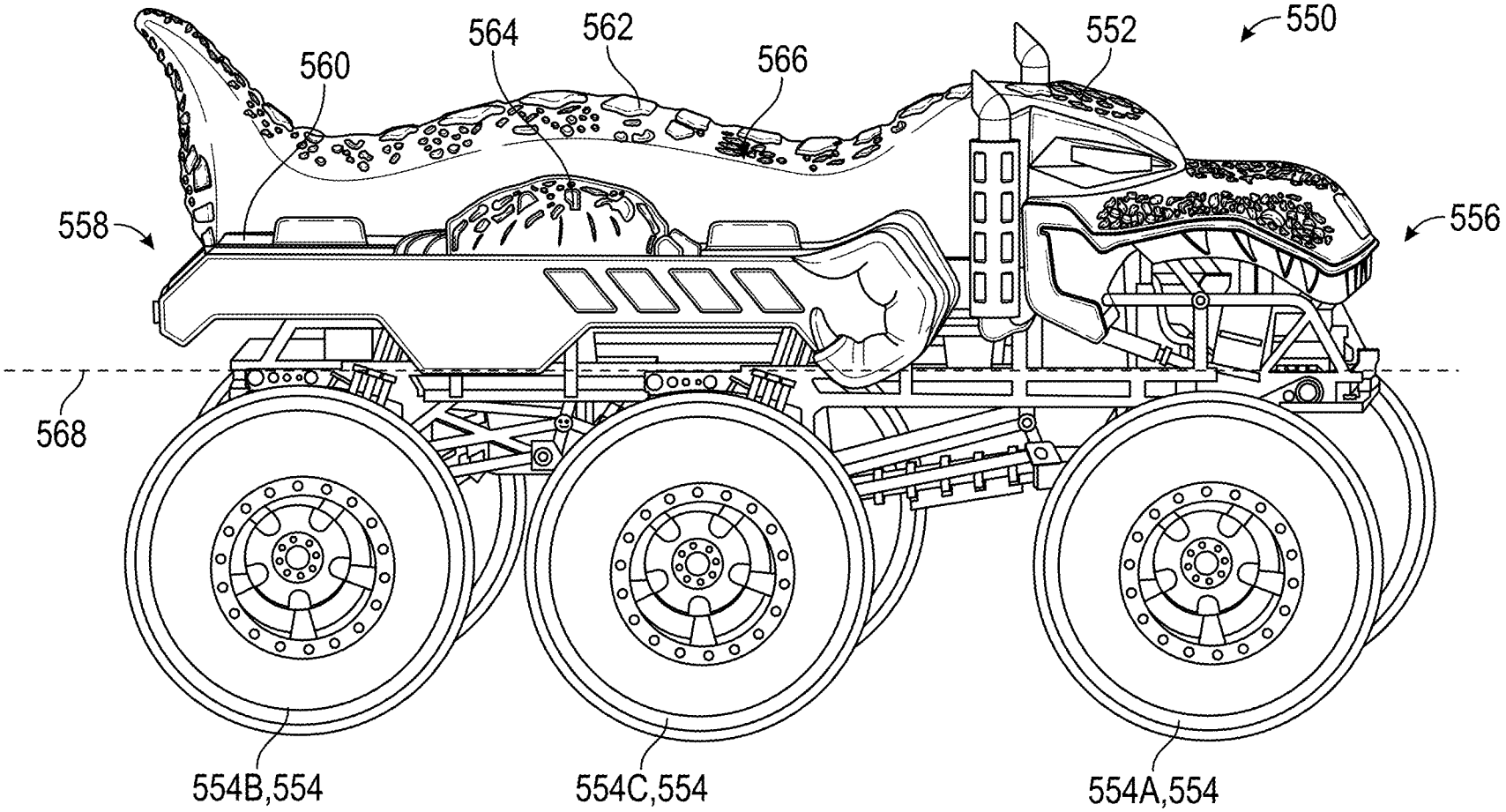
FIG. 5A illustrates a side perspective view of still another toy vehicle in accordance with example embodiments of the present application.

FIG. 5A illustrates a side perspective view of a seventh toy vehicle 550 (e.g., a fourth primary vehicle). The seventh toy vehicle 550 includes a body 552 and three pairs of wheels 554, which includes front wheels 554A positioned at a first end 556 (e.g., a front) of the body 552, rear wheels 554B positioned at a second end 558 (e.g., a rear), opposite the first end 556, of the body 552, and intermediate wheels 554C positioned between the first end 556 and the second end 558. The body 552 of the seventh toy vehicle 550 is elongated.

The seventh toy vehicle 550 also includes a base 560 (e.g., a flatbed) and a prop 562—albeit a prop 562 with decorative shaping/styling—serving as the support for coupling to an additional toy vehicle via placement of the additional toy vehicle on the base 560. The base 560 includes bumps or blocks 564 that define a recess 566 configured to receive one of the wheels of the additional toy vehicle, thereby blocking substantial movement of the additional toy vehicle relative to the seventh toy vehicle along a longitudinal axis 568. Consequently, placement of the additional toy vehicle on the seventh toy vehicle 550 is maintained.

Figure 5B:
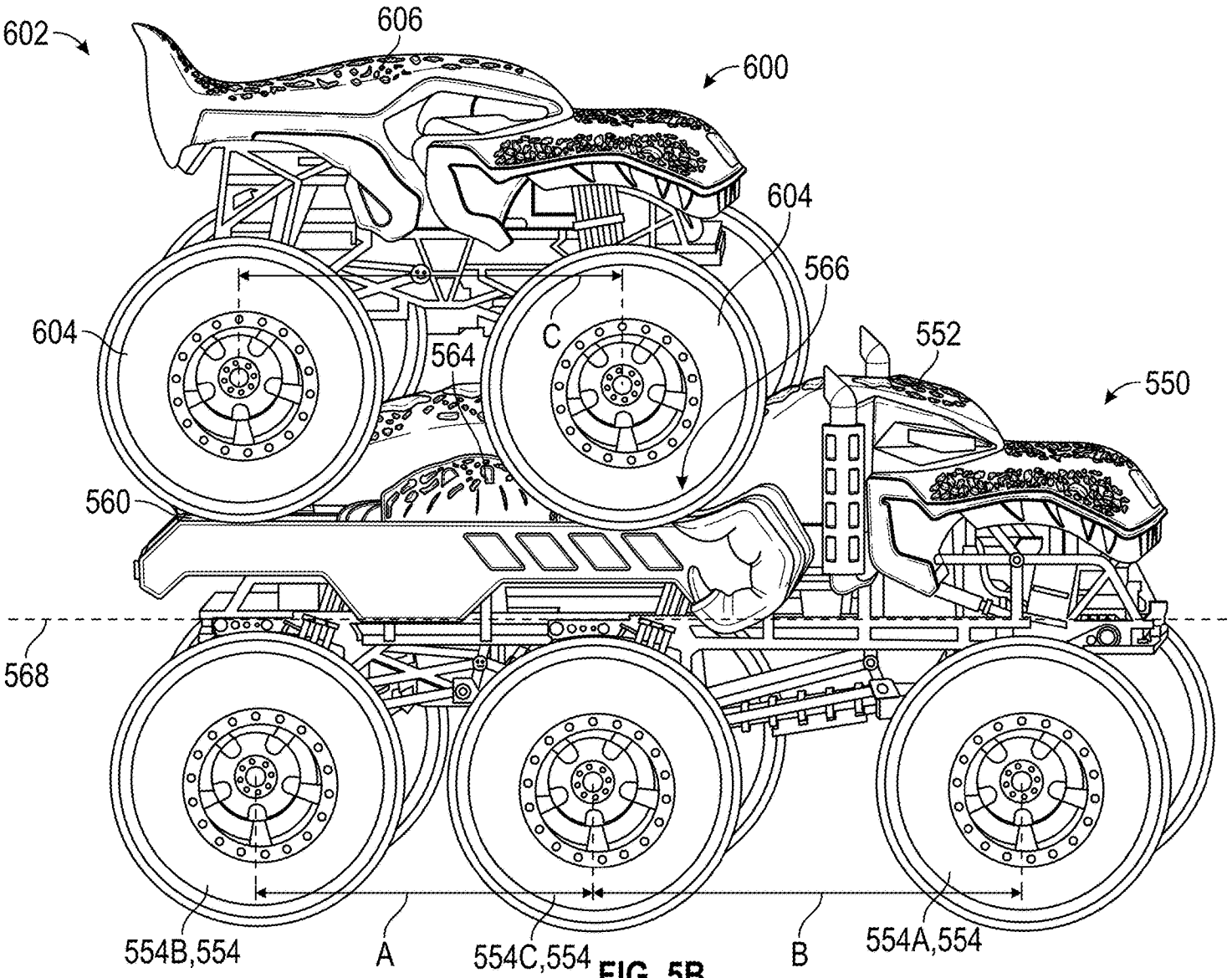
FIG. 5B illustrates a side perspective view of the toy vehicle of FIG. 5A coupled to an additional toy vehicle in accordance with example embodiments of the present application.

FIG. 5B illustrates a side view of the seventh toy vehicle 550 coupled to an eighth toy vehicle 600 (e.g., a fourth secondary toy vehicle) to provide a fourth toy vehicle playset 602. The eighth toy vehicle 600 includes two pairs of wheels 604 and a body 606 that is relatively shorter than the body 552 of the seventh toy vehicle 550. The eighth toy vehicle 600 is placed on the base 560 of the seventh toy vehicle 550 to engage the wheels 604 of the eighth toy vehicle 600 with the base 560 to couple the seventh toy vehicle 550 and the eighth toy vehicle 600 to one another such that the seventh toy vehicle 550 is configured to carry the eighth toy vehicle 600. By way of example, a wheel 604 (e.g., a front wheel) of the eighth toy vehicle 600 is positioned within the recess 566 defined by the base 560 and the bumps 564 of the seventh toy vehicle 550 to block substantial movement of the eighth toy vehicle 600 relative to the seventh toy vehicle 550 along the longitudinal axis 568. The wheels 554 of the seventh toy vehicle 550 and the wheels 604 of the eighth toy vehicle 600 may have similar dimensions, such as substantially the same diameters. Additionally, the intermediate wheels 554C of the seventh toy vehicle 550 are positioned closer to the rear wheels 554B than to the front wheels 554A. In other words, the distance between the intermediate wheels 554C and rear wheels 554B (shown as a distance "A") is less than the distance between the intermediate wheels 554C and front wheels 554A (shown as a distance "B"). Positioning the intermediate wheels 554C closer to the rear wheels 554B provides added support for the extra weight of the eighth toy vehicle 600, which is positioned closer to the back of the seventh toy vehicle 550. Furthermore, in the embodiment shown in FIG. 5B, the distance "A" between the intermediate wheels 554C and rear wheels 554B is less than the distance between the wheels 604 of the eighth toy vehicle 600 (shown as a distance "C"). In other embodiments, distance "A" may be the same as distance "C" or greater than the distance "C."

Figure 5C:
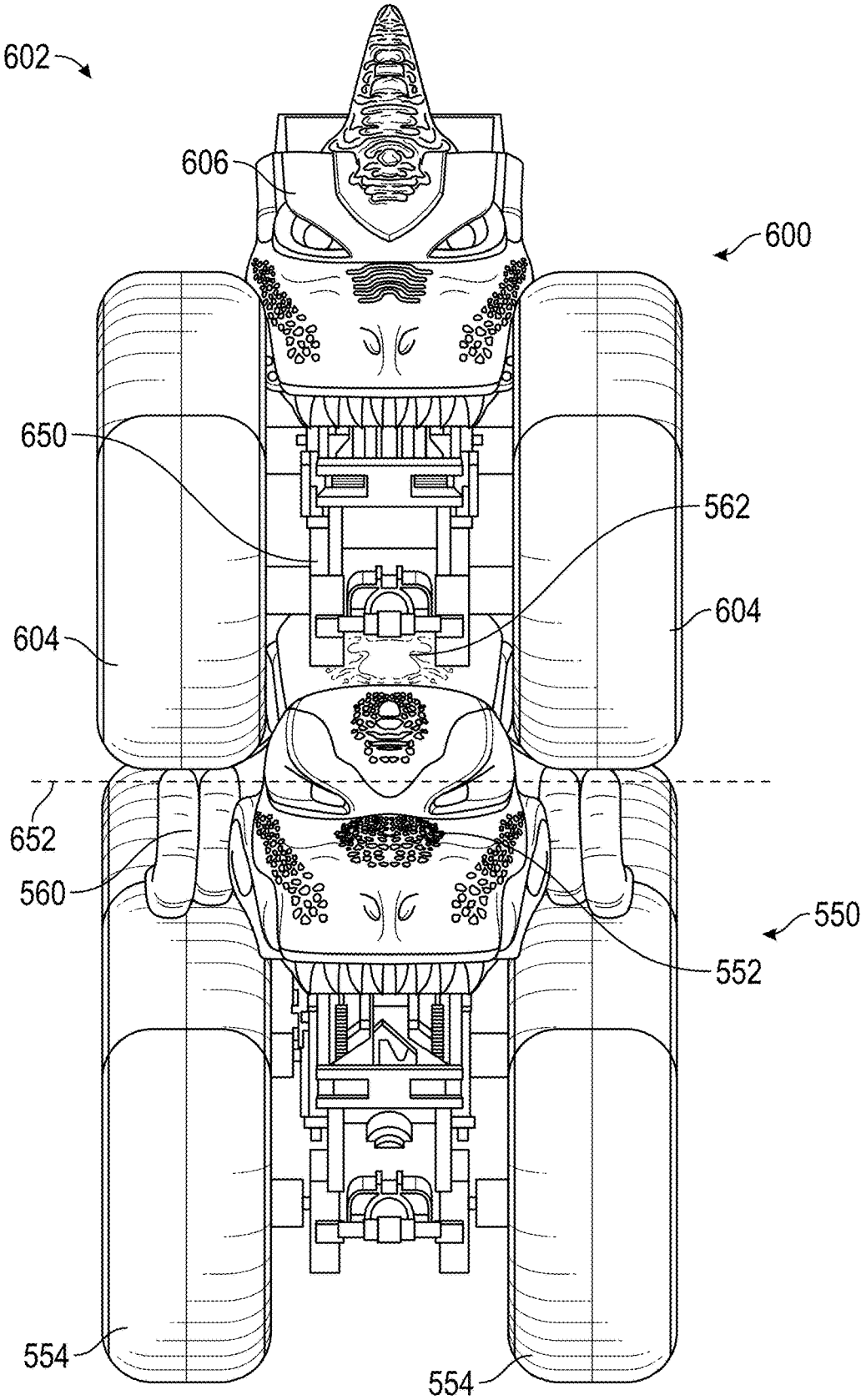
FIG. 5C illustrates a front perspective view of the toy vehicle of FIG. 5A coupled to the additional toy vehicle in accordance with example embodiments of the present application.

FIG. 5C illustrates a front perspective view of the seventh toy vehicle 550 coupled to the eighth toy vehicle 600 via placement of the seventh toy vehicle 550 on the base 560 of the eighth toy vehicle 600. The illustrated eighth toy vehicle 600 includes a frame 650 extending from the body 606, and the frame 650 serves as the mount and engages with the prop 562 upon placement of the eighth toy vehicle 600 on the seventh toy vehicle 550. Engagement of the prop 562 with the frame 650 increases contact between the seventh toy vehicle 550 and the eighth toy vehicle 600 to block relative movement between the seventh toy vehicle 550 and the eighth toy vehicle 600 via a frictional force. Moreover, placement of the eighth toy vehicle 600 on the seventh toy vehicle 550 positions the prop 562 of the seventh toy vehicle 550 between opposing wheels 604 of each pair of wheels 604. In other words, the wheels 604 of the eighth toy vehicle 600 straddle and capture the prop 562. Such engagement of the wheels 604 of the eighth toy vehicle 600 with the prop 562 of the seventh toy vehicle 550 blocks movement of the eighth toy vehicle 600 relative to the seventh toy vehicle 550 along a lateral axis 652 to maintain placement of the eighth toy vehicle 600 on the base 560.

A dimension (e.g., a distance between the wheels 554 of the same axle) of the seventh toy vehicle 550 may be the same as or substantially similar to a dimension (e.g., a distance between the wheels 604 of the same axle) of the eighth toy vehicle 600, and a width and/or diameter of the wheels 554 of the seventh toy vehicle 550 and a width and/or diameter of the wheels 604 of the eighth toy vehicle 600 may also be similar (e.g., substantially the same dimension) to one another. Thus, the bodies 552, 606 of the seventh toy vehicle 550 and of the eighth toy vehicle 600 may be aligned with one another along the lateral axis 652 and the wheels 554, 604 of the seventh toy vehicle 550 and of the eighth toy vehicle 600 may be aligned with one another along the lateral axis 652 when the eighth toy vehicle 600 is stacked on the seventh toy vehicle 550. Such an alignment may help position the wheels 604 of the eighth toy vehicle 600 in the recesses 566 of the base 560 of the seventh toy vehicle 550 to help secure the seventh toy vehicle 550 to the eighth toy vehicle 600.

The base 560 of the seventh toy vehicle 550 extends sufficiently outward along the lateral axis 652 to accommodate the wheels 604 of the eighth toy vehicle 600. That is, the base 560 provides a sufficient surface area of engagement with the wheels 604 for the eighth toy vehicle 600 to balance atop the seventh toy vehicle 550. To this end, a width of the base 560 of the seventh toy vehicle 550 along the lateral axis 652 may be greater than a width of the body 606 of the eighth toy vehicle 600 along the lateral axis 652 to accommodate a distance between the wheels 604 of the same axle (e.g., a distance substantially similar to that between the wheels 554 of the same axle) and sufficiently engage with the wheels 604. Thus, the base 560 may overlap with the wheels 554 of the seventh toy vehicle 550 along the lateral axis 652.

Figure 6A:
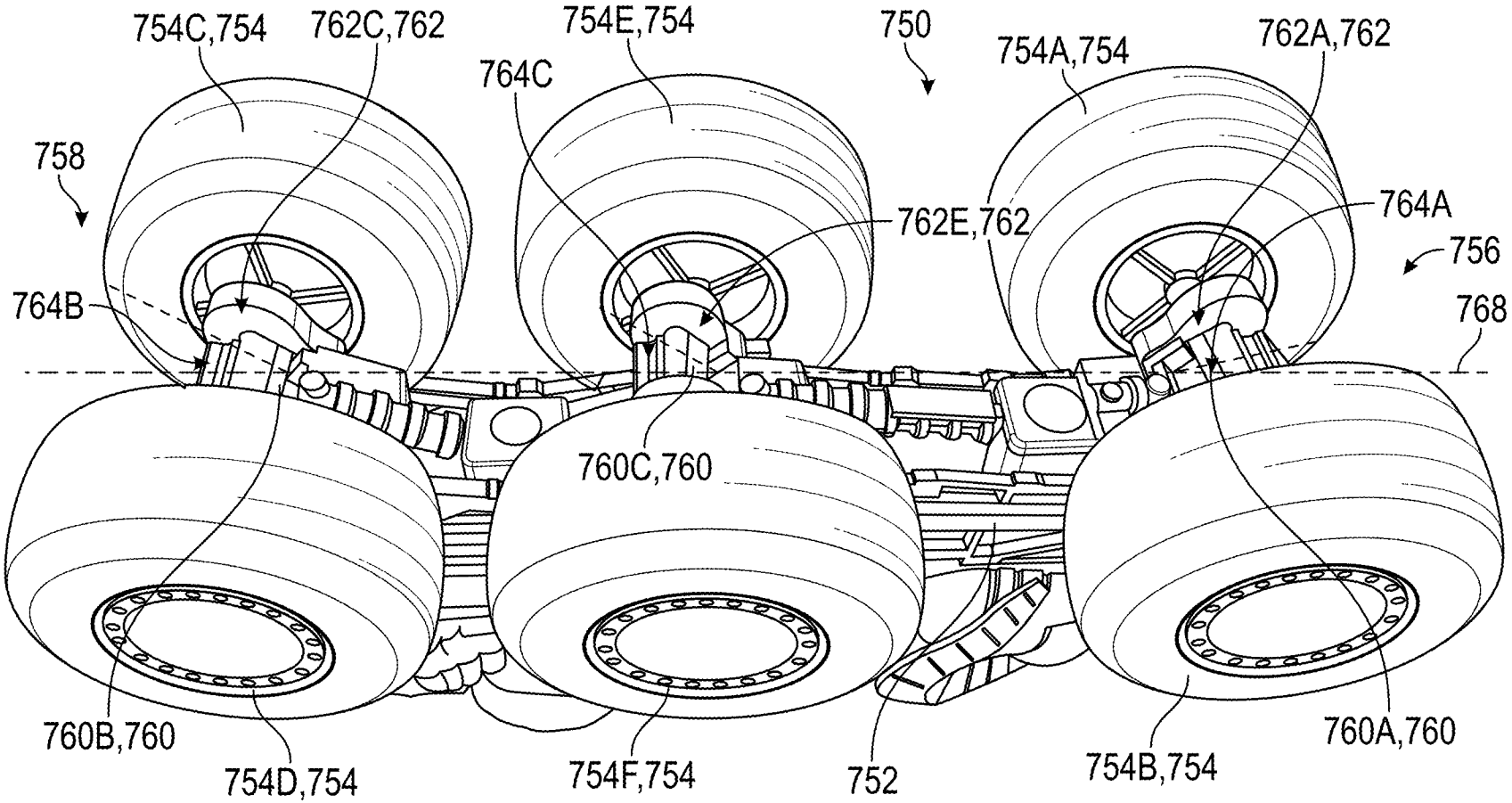
FIG. 6A illustrates a bottom perspective view of yet another toy vehicle in accordance with example embodiments of the present application.
Figure 6B:
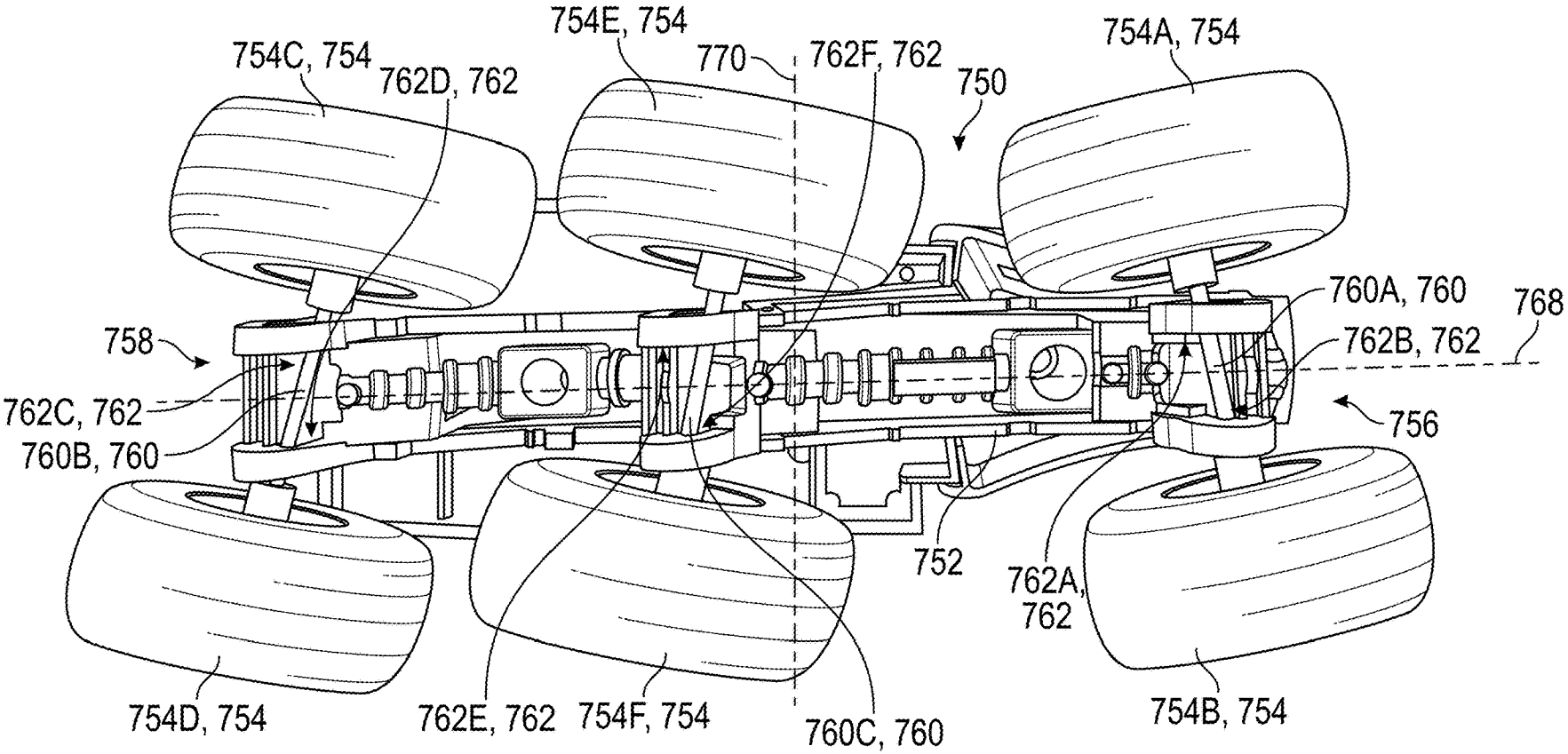
FIG. 6B illustrates a bottom view of the toy vehicle of FIG. 6A as it is turning in accordance with example embodiments of the present application.

FIGS. 6A and 6B illustrate a ninth toy vehicle 750. For ease of description, elements of the ninth toy vehicle 750 from FIGS. 6A and 6B will be discussed together. FIG. 6A illustrates a bottom perspective view of the ninth toy vehicle 750. The ninth toy vehicle 750 includes a body 752 and three pairs of wheels 754, which includes front wheels 754A, 754B positioned at a first end 756 (e.g., a front) of the body 752, rear wheels 754C, 754D positioned at a second end 758 (e.g., a rear) opposite the first end 756 of the body 752, and intermediate wheels 754E, 754F positioned between the first end 756 and the second end 758. Three axles 760 connect the respective pairs of wheels 754. More specifically, front wheels 754A, 754B are connected to a front axle 760A, rear wheels 754C, 754D are connected to a rear axle 760B, and intermediate wheels 754E, 754F are connected to an intermediate axle 760C.

The body 752 of the ninth toy vehicle 750 includes three pairs of elongated angular openings 762 which support the axles 760. As shown in FIG. 6B, front axle 760A passes through front openings 762A, 762B, rear axle 760B passes through rear openings 762C, 762D, and intermediate axle 760C passes through intermediate openings 762E, 762F. Turning back to FIG. 6A, though only one angular opening from each pair of elongated angular openings is visible (i.e., openings 762A, 762C, 762E), it is to be understood that the openings not visible (i.e., openings 762B, 762D, 762F) have the same dimensions and positioning as their respective visible counterparts. The elongated angular openings 762 are generally the same size, though in some embodiments, different pairs of openings may be different shapes and/or sizes. Front openings 762A, 762B extend toward the first end 756 at a first angle 764A relative to a longitudinal axis 768 extending along and/or defined by the body 752 of the ninth toy vehicle 750. First angle 764A is between 0 and 90 degrees and in certain embodiments, is approximately 45 degrees. Rear openings 762C, 762D and intermediate openings 762E, 762F respectively extend toward the second end 758 at a second angle 764B and third angle 764C relative to the longitudinal axis 768. Second angle 764B and third angle 764C are also between 0 and 90 degrees and in certain embodiments, are both approximately 45 degrees. In the embodiment depicted in FIG. 6A, second angle 764B and third angle 764C are the same angle, and first angle 764A is a different angle from both the second angle 764B and third angle 764C. The elongated angular openings 762 are angled such that the axles 760 are located in a position within each angular opening 762 that is closest to the body 752 (e.g., as a result of a gravitational force that urges the body 752 and the axles 760 toward one another) when the ninth toy vehicle 750 is stationary (as shown in FIG. 6A) or moving in a straight line. This results in the axles 760 being generally perpendicular to the longitudinal axis 768.

FIG. 6B shows a bottom perspective view of the ninth toy vehicle 750 while it is turning, for example by a user manually tilting the body 752 of the toy vehicle 750 towards the direction of the turn or as the ninth toy vehicle 750 is guided through a turn on a toy vehicle track or playset. In the example shown in FIG. 6B, the ninth toy vehicle 750 is making a right turn, and the body 752 is tilted or leans towards the wheels 754A, 754C, 754E on its right side. When the body 752 is tilted, one side of the body 752 and openings 762B, 762D, 762F are lifted higher than the openings 762A, 762C, 762E on the opposite side of the body 752. The lifting of openings 762B, 762D, 762F causes the axles 760 to slide to a position within the openings 762B, 762D, 762F that is further away from the body 752 (e.g., in a downward direction relative to the body 752). Due to the angle and positioning of the elongated openings 762B, 762D, 762F, the axles 760 (and the wheels 754 connected to the axles 760) subsequently lean or tilt and are no longer perpendicular to the longitudinal axis 768.

Furthermore, because the rear openings 762C, 762D and the intermediate openings 762E, 762F extend in an opposite direction (i.e., toward the second end 758) than a direction (i.e., the first end 756) toward which the front openings 762A, 762B extend, the rear axle 760B and intermediate axle 760C tilt or lean in the same direction with one another and opposite the direction in which the front axle 760A leans or tilts, resulting in the rear wheel 754C and intermediate wheel 754E leaning towards a central plane 770 that bisects the body 752, and the rear wheel 754D and intermediate wheel 754F leaning away from central plane 770. In the embodiment shown in FIG. 6B, the rear openings 762C, 762D and the intermediate openings 762E, 762F are all positioned at the same angle and thus, the rear axle 760B and intermediate axle 760C tilt or lean the same amount. This tilting arrangement of the axles 760 and wheels 754 allows the toy vehicle 750 to smoothly turn right with a tight turning radius, even with an elongated body and six wheels. It is to be understood that the ninth toy vehicle 750 turns left utilizing the same mechanics, except that the elongated angular openings 762 being lifted are switched (i.e., openings 762A, 762C, 762E) and subsequently, the axles 760 lean or tilt in respective directions opposite to that depicted in FIG. 6B.

While the toy vehicles presented herein have been illustrated and described in detail and with reference to specific embodiments thereof, it is nevertheless not intended to be limited to the details shown, since it will be apparent that various modifications and structural changes may be made therein without departing from the scope of the disclosure and within the scope and range of equivalents of the claims. In addition, various features from one of the embodiments may be incorporated into another of the embodiments. That is, it is believed that the disclosure set forth above encompasses multiple distinct embodiments with independent utility. While each of these embodiments has been disclosed in a preferred form, the specific embodiments thereof as disclosed and illustrated herein are not to be considered in a limiting sense as numerous variations are possible. The subject matter of the disclosure includes all novel and non-obvious combinations and subcombinations of the various elements, features, functions and/or properties disclosed herein. Accordingly, it is appropriate that the appended claims be construed broadly and in a manner consistent with the scope of the disclosure as set forth in the following claims.

It is also to be understood that the toy vehicles described herein, or portions thereof may be fabricated from any suitable material or combination of materials, such as plastic, foamed plastic, wood, cardboard, pressed paper, metal, supple natural or synthetic materials including, but not limited to, cotton, elastomers, polyester, plastic, rubber, derivatives thereof, and combinations thereof. Suitable plastics may include high-density polyethylene (HDPE), low-density polyethylene (LDPE), polystyrene, acrylonitrile butadiene styrene (ABS), polycarbonate, polyethylene terephthalate (PET), polypropylene, ethylene-vinyl acetate (EVA), or the like. Suitable foamed plastics may include expanded or extruded polystyrene, expanded or extruded polypropylene, EVA foam, derivatives thereof, and combinations thereof.

Additionally, it is to be understood that terms such as "left," "right," "top," "bottom," "front," "rear," "side," "height," "length," "width," "upper," "lower," "interior," "exterior," "inner," "outer" and the like as may be used herein, merely describe points of reference and do not limit the present disclosure to any particular orientation or configuration. Further, the term "exemplary" is used herein to describe an example or illustration. Any embodiment described herein as exemplary is not to be construed as a preferred or advantageous embodiment, but rather as one example or illustration of a possible embodiment of the disclosure.

Moreover, when used herein, the term "comprises" and its derivations (such as "comprising", etc.) should not be understood in an excluding sense, that is, these terms should not be interpreted as excluding the possibility that what is described and defined may include further elements, steps, etc. Similarly, where any description recites "a" or "a first" element or the equivalent thereof, such disclosure should be understood to include incorporation of one or more such elements, neither requiring nor excluding two or more such elements. Meanwhile, when used herein, the term "approximately" and terms of its family (such as "approximate", etc.) should be understood as indicating values very near to those which accompany the aforementioned term. That is to say, a deviation within reasonable limits from an exact value should be accepted, because a skilled person in the art will understand that such a deviation from the values indicated is inevitable due to measurement inaccuracies, etc. The same applies to the terms "about" and "around" and "substantially". For example, the term "approximately" can denote a tolerance of plus or minus 0.002 inches, 0.001 inches, or up to 0.005 inches. The same applies to the terms "about" and "around" and "substantially." Moreover, for the purposes of the present disclosure, the phrase "A and/or B" means (A), (B), or (A and B), and the phrase "A, B, and/or C" means (A), (B), (C), (A and B), (A and C), (B and C), or (A, B and C).

Finally, the techniques presented and claimed herein are referenced and applied to material objects and concrete examples of a practical nature that demonstrably improve the present technical field and, as such, are not abstract, intangible, or purely theoretical. Further, if any claims appended to the end of this specification contain one or more elements designated as "means for [perform]ing [a function] . . . " or "step for [perform]ing [a function] . . . ", it is intended that such elements are to be interpreted under 35 U.S.C. 112 (f). However, for any claims containing elements designated in any other manner, it is intended that such elements are not to be interpreted under 35 U.S.C. 112 (f).

What is claimed is:

1. A toy vehicle, comprising:

a body extending along a longitudinal axis;

a first extension, a second extension, and a third extension extending along the body transverse to the longitudinal axis;

a first axle, a second axle, and a third axle connected to the first extension, the second extension, and the third extension, respectively;

a first wheel and a second wheel defining a first pair of wheels coupled to the first axle, a third wheel and a fourth wheel defining a second pair of wheels coupled to the second axle, and a fifth wheel and a sixth wheel defining a third pair of wheels coupled to the third axle, wherein the first wheel, the third wheel, and the fifth wheel are positioned on a first side of the body and the second wheel, the fourth wheel, and the sixth wheel are positioned on a second side of the body; and a support configured to couple to an additional toy vehicle;

wherein tilting the body to the first side causes the first axle to rotate in a first rotational direction to form an acute angle with the longitudinal axis and causes the second axle and the third axle to rotate in a second rotational direction, different from and opposite to the first rotational direction, to form other respective acute angles with the longitudinal axis and the first extension, the second extension, and the third extension are spaced apart to allow corresponding wheels of the first pair of wheels, the second pair of wheels, and the third pair of wheels to extend inwardly beyond the first extension, the second extension, and the third extension, respectively, while the body is tilted to the first side.

2. The toy vehicle of claim 1, wherein the support comprises a hitch configured to couple to the additional toy vehicle such that the toy vehicle drags the additional toy vehicle.

3. The toy vehicle of claim 2, wherein the hitch is configured to move relative to the body to transition the toy vehicle between an extended configuration and a retracted configuration.

4. The toy vehicle of claim 3, wherein the hitch is configured to rotate relative to the body.

5. The toy vehicle of claim 3, wherein the hitch comprises fingers configured to couple to the additional toy vehicle, the fingers are offset from the body along the longitudinal axis in the extended configuration of the toy vehicle, and the fingers overlap with the body along the longitudinal axis in the retracted configuration of the toy vehicle.

6. The toy vehicle of claim 1, wherein the support comprises a base configured to couple to the additional toy vehicle such that the toy vehicle carries the additional toy vehicle.

7. The toy vehicle of claim 6, wherein the support comprises a prop extending along the base, and the prop is configured to engage with the additional toy vehicle.

8. A toy vehicle playset, comprising:

a first toy vehicle comprising a body extending along a longitudinal axis, a first plurality of wheels and a plurality of axles coupled to pairs of wheels of the first plurality of wheels, and a plurality of extensions extending along the body transverse to the longitudinal axis and supporting the plurality of axles, wherein tilting the first toy vehicle body for a turn causes a first axle of the plurality of axles to rotate in a first rotational direction to extend traverse to the longitudinal axis and causes a second axle of the plurality of axles to rotate in a second rotational direction, different from and opposite the first rotational direction, to extend transverse to the longitudinal axis and the plurality of extensions are spaced apart to allow corresponding wheels of the first plurality of wheels to extend inwardly beyond the plurality of extensions, respectively, while the first toy vehicle body is tilted for the turn; and a second toy vehicle comprising a second plurality of wheels, wherein a quantity of the first plurality of wheels is greater than a quantity of the second plurality of wheels, and the second toy vehicle is configured to couple to the first toy vehicle;

wherein the first toy vehicle and the second toy vehicle are of a common width.

9. The toy vehicle playset of claim 8, wherein each wheel of the first plurality of wheels and of the second plurality of wheels have a common width.

10. The toy vehicle playset of claim 9, wherein:

the first plurality of wheels of the first toy vehicle comprises a first pair of wheels, a second pair of wheels, and a third pair of wheels, wherein a first distance between the first pair of wheels and the second pair of wheels is greater than a second distance between the second pair of wheels and the third pair of wheels; and the second plurality of wheels of the second toy vehicle comprises a fourth pair of wheels and a fifth pair of wheels, wherein a third distance between the fourth pair of wheels and the fifth pair of wheels is greater than the second distance between the second pair of wheels and the third pair of wheels.

11. The toy vehicle playset of claim 8, wherein the first toy vehicle comprises a hitch, the second toy vehicle comprises a frame, and the hitch is configured to couple to the frame.

12. The toy vehicle playset of claim 11, wherein the first toy vehicle comprises:

an arm extending from the body, and the hitch extends from the arm.

13. The toy vehicle playset of claim 12, wherein the hitch is configured to rotate relative to the arm to transition the first toy vehicle between an extended configuration and a retracted configuration, the hitch extends along the arm in the retracted configuration, and the arm includes a cutout configured to receive the hitch in the retracted configuration.

14. The toy vehicle playset of claim 11, wherein the second toy vehicle comprises an axle coupled to a pair of wheels of the second plurality of wheels, the axle extends from the frame, and the hitch is configured to couple to the axle.

15. The toy vehicle playset of claim 14, wherein the hitch comprises fingers that are offset from one another to define a gap therebetween, the fingers extend arcuately to form a recess, the fingers are configured to capture the frame within the gap, and the fingers are configured to capture the axle within the recess.

16. The toy vehicle playset of claim 8, wherein the first toy vehicle comprises a base configured to engage with the second plurality of wheels of the second toy vehicle, the base comprises a plurality of bumps defining a recess, and the plurality of bumps is configured to capture a wheel of the second plurality of wheels of the second toy vehicle within the recess.

17. The toy vehicle playset of claim 16, wherein the first toy vehicle comprises a prop extending along the base, and the prop is configured to extend between the second plurality of wheels.

18. The toy vehicle playset of claim 17, wherein the second toy vehicle comprises a frame, the frame includes lips that are offset from one another to define a gap, and the lips are configured to capture the prop within the gap.

19. A toy vehicle, comprising:

a body extending from a first end to a second end along a longitudinal axis a first extension, a second extension, and a third extension extending along the body transverse to the longitudinal axis, wherein the first extension includes a first pair of elongated angular openings, the second extension includes a second pair of elongated angular openings, and the third extension includes a third pair of elongated angular openings, the first pair of elongated angular openings extending along the longitudinal axis towards the first end at an angle less than 90 degrees relative to the longitudinal axis, and the second pair of elongated angular openings and the third pair of elongated angular openings extending along the longitudinal axis towards the second end at another angle less than 90 degrees relative to the longitudinal axis;

three axles connected to the first extension, the second extension, and the third extension, respectively three pairs of wheels, wherein each pair of wheels of the three pairs of wheels is coupled to a respective axle of the three axles; and a support configured to couple to an additional toy vehicle, wherein the toy vehicle and the additional toy vehicle are of a common width wherein tilting the body to a side causes the three axles to rotate to form respective acute angles with the longitudinal axis, and the first extension, the second extension, and the third extension are spaced apart to allow corresponding wheels of the three pairs of wheels to extend inwardly beyond the first extension, the second extension, and the third extension, respectively, while the body is tilted to the side.

20. The toy vehicle of claim 19, wherein tilting the body to a side for a turn causes a first axle of the three axles to rotate in a first rotational direction within the first pair of elongated angular openings and causes a second axle and a third axle to rotate in a second rotational direction, opposite the first rotational direction, within the second pair of elongated angular openings and the third pair of elongated angular openings, respectively.

* * * * *